US006859629B2

(12) United States Patent
Miura et al.

(10) Patent No.: US 6,859,629 B2
(45) Date of Patent: Feb. 22, 2005

(54) IMAGE FORMING APPARATUS HAVING DEVELOPER CONTAINER WITH LIGHT TRANSMITTING WINDOW USED FOR REMAINING DEVELOPER AMOUNT DETECTION

(75) Inventors: Koji Miura, Shizuoka (JP); Jun Miyamoto, Shizuoka (JP); Kojiro Yasui, Shizuoka (JP); Takeshi Arimitsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 10/281,966

(22) Filed: Oct. 29, 2002

(65) Prior Publication Data

US 2003/0086715 A1 May 8, 2003

(30) Foreign Application Priority Data

Nov. 7, 2001 (JP) ..... 2001-341604

(51) Int. Cl.[7] ..... G03G 15/08
(52) U.S. Cl. ..... 399/64; 118/691
(58) Field of Search ..... 399/27, 64; 118/691; 340/612, 617; 356/436, 440; 250/573, 576, 577

(56) References Cited

U.S. PATENT DOCUMENTS

| | | | | |
|---|---|---|---|---|
| 5,036,358 A | * | 7/1991 | Yoshida | 399/64 |
| 5,649,264 A | * | 7/1997 | Domon et al. | 399/30 |
| 5,682,574 A | * | 10/1997 | Oshida et al. | 399/64 |
| 5,926,666 A | | 7/1999 | Miura et al. | 399/25 |
| 5,946,531 A | | 8/1999 | Miura et al. | 399/111 |
| 5,950,047 A | | 9/1999 | Miyabe et al. | 399/111 |
| 6,055,406 A | | 4/2000 | Kawai et al. | 399/360 |
| 6,061,538 A | | 5/2000 | Arimitsu et al. | 399/111 |
| 6,167,219 A | | 12/2000 | Miyamoto et al. | 399/90 |
| 6,173,130 B1 | * | 1/2001 | Oguma | 399/27 |
| 6,336,017 B1 | | 1/2002 | Miyamoto et al. | 399/116 |
| 6,351,620 B1 | | 2/2002 | Miyabe et al. | 399/111 |
| 6,553,189 B2 | * | 4/2003 | Miyamoto et al. | 399/27 |

FOREIGN PATENT DOCUMENTS

JP 08123187 A * 5/1996 ..... G03G/15/08

* cited by examiner

*Primary Examiner*—Robert Beatty
(74) *Attorney, Agent, or Firm*—Fitzpatrick, Cella, Harper & Scinto

(57) ABSTRACT

A developer container for accommodating a developer used for developing an electrostatic latent image formed on an electrophotographic photosensitive member by a developing member for developing the electrostatic latent image includes, a first light-transmitting window for guiding detection light emitted from a light emitting member provided in a main body of an image forming apparatus into the developer container, a second light-transmitting window for guiding the detection light entering from the first light-transmitting window and passing through the developer container to a photosensing member provided in the main body of the image forming apparatus, in order to detect the remaining amount of the developer accommodated within the developer container when the developer container is mounted in the main body of the image forming apparatus, and a rotatable feeding member including a stirring blade for feeding the developer within the developer container toward the developing member when rotating, and for removing particles of the developer adhering to the first light-transmitting window and the second light-transmitting window by contacting the first light-transmitting window and second light-transmitting window. At least one of the respective inner surfaces of the light-transmitting window and the second light-transmitting window facing the inside of the developer container has an inner inclined portion having a circular convex portion, convex along a longitudinal direction of the rotating feeding member.

17 Claims, 14 Drawing Sheets

FIG.9A
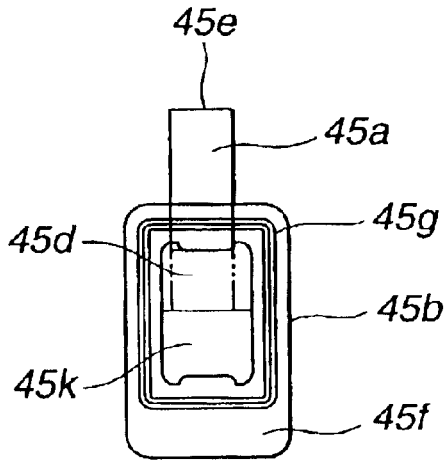
FIG.9B
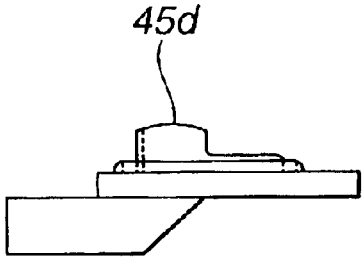
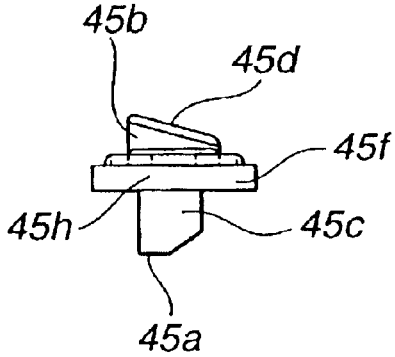
FIG.9C
FIG.9D
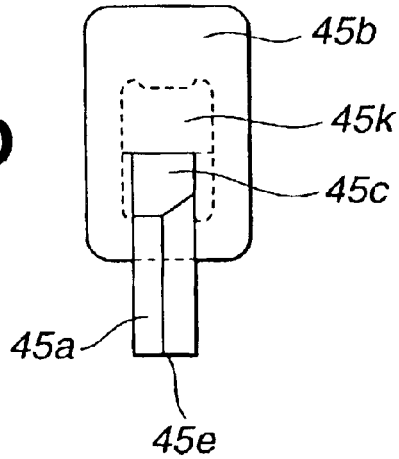

FIG.10A
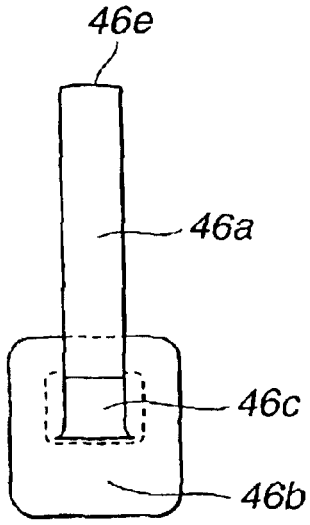
FIG.10B
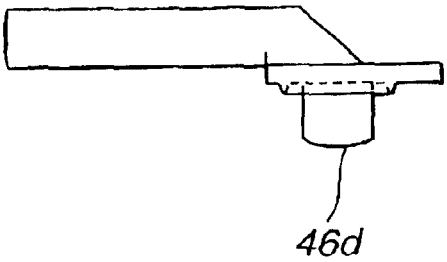
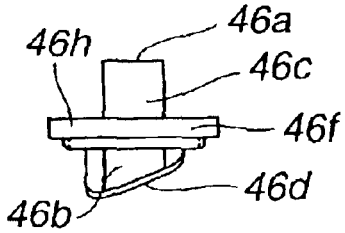
FIG.10C
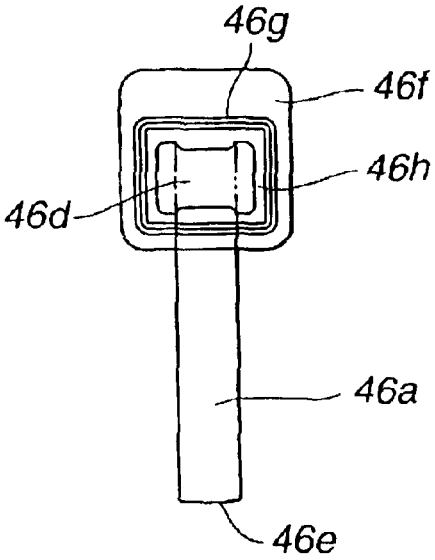
FIG.10D

IMAGE FORMING APPARATUS HAVING DEVELOPER CONTAINER WITH LIGHT TRANSMITTING WINDOW USED FOR REMAINING DEVELOPER AMOUNT DETECTION

BACKGROUND OF THE INVENTION

1. Field of the Invention

The present invention relates to an image forming apparatus, a process cartridge that can be detachably mounted in the main body of the image forming apparatus, a developing device, a developer container, a method of improving the transmission of a developer-amount detection light through a developer container, a method of detecting the amount of developer in a developer container, a method of feeding a developer to a developer member, and a method of developing an electrostatic latent image formed on an electrophotographic photosensitive member.

2. Description of the Related Art

Image forming apparatuses using an electrophotographic process, such as printers and the like, perform image recording by uniformly charging a photosensitive drum, serving as an electrophotographic photosensitive member, forming an electrostatic latent image by performing selective exposure on the photosensitive drum, visualizing the electrostatic latent image by developing it using a toner, serving as a developer, transferring the obtained toner image onto a recording medium, and fixing the toner image on the recording medium by supplying the transferred toner image with heat and pressure.

Such apparatuses require toner replenishment and maintenance of various process means. As means for facilitating toner replenishment and maintenance, cartridges in which the photosensitive drum, charging means, developing means, cleaning means and the like are integrated within a frame have been practically used.

A developing device in such a process cartridge includes a developer-remaining-amount detection device for detecting the remaining amount of an accommodated developer. One of developer-remaining-amount detection methods is a light-transmitting remaining-amount detection method that is less expensive and has a simple configuration. In this method, the remaining amount of a developer accommodated within a container is obtained by causing detection light to pass through the container and measuring the time period of detection of the detection light.

The configuration of a conventional light-transmitting remaining-amount detection device will now be described with reference to FIGS. 13 and 14. As shown in FIGS. 13 and 14, a process cartridge 7 includes a photosensitive drum 1, serving as an image bearing member, a developer container or receptacle 25 accommodating a toner T, serving as a developer, to be supplied to the photosensitive drum 1, and a stirring blade 28*b* for stirring the toner T within the developer container 25 and conveying the toner T toward a supply roller 29.

After uniformly charging the surface of the photosensitive drum 1 by a charging roller 2, an electrostatic latent image is formed on the photosensitive drum 1 by projecting a laser beam corresponding to image information from a scanner unit (not shown) to the drum 1, and the toner T is supplied to the electrostatic latent image via the supply roller 29 and a developing roller 27, to form a toner image.

As shown in FIG. 14, detection light L emitted from a light emitting device 30*a*, serving as a light emitting member, passes through a first guide unit 31*a* made of a transparent material and enters the developer receptacle 25 from a first light-transmitting window 51*a* provided at the developer container 25.

The detection light L entering the developer container 25 leaves the developer container 25 from a second light-transmitting window 51*b* provided at the developer container 25. The detection light L leaving the developer container 25 reaches a photosensor 30*b*, serving as a photosensing member, via a second guide unit 31*b* made of a transparent material. The remaining amount of the toner T within the developer container 25 is detected based on the time period of detection of the detection light L by the photosensor 30*b*.

A rotating feeding member 28 for feeding the toner T accommodated within the developer container 25 toward a developing member comprising the supply roller 29, the developing roller 27 and the like contacts an inner inclined portion 51*c* of the first light-transmitting window 51*a* and an inner inclined portion of the second light-transmitting window 51*b* at every rotation. That is, by wiping the inner inclined portions 51*c* and 51*d* of the first and second light-transmitting windows 51*a* and 51*b* by the stirring blade 28*b*, which is made of a flexible plastic sheet with mean wiping forces SK and SK', respectively, the toner T adhering to the inner inclined portions 51*c* and 51*d* is cleaned to allow transmission of light.

In the above-described conventional approach, however, although the inner inclined portions 51*c* and 51*d* of the first and second light-transmitting windows 51*a* and 51*b*, respectively, are cleaned at every rotation of the rotating feeding member 28, it is impossible to completely remove the adhering toner T, and the toner T more or less remains. As a result, the transmission loss of light increases, and it is therefore necessary to increase in advance the intensity of the detection light L emitted from the light emitting device 30*a* in consideration of the transmission loss.

SUMMARY OF THE INVENTION

The present invention has been made in consideration of the above-described problems.

It is an object of the present invention to provide a developer container, a developing device, a process cartridge, and an image forming apparatus detachably mountable the process cartridge, and a method in which the remaining amount of a developer accommodated within the developer container can be detected.

It is another object of the present invention to provide a developer container, a developing device, a process cartridge, and an image forming apparatus detachably mountable on the process cartridge, wherein the developer container has a light-transmitting window in which the loss of detection light for detecting the remaining amount of a developer accommodated within the developer container is reduced.

It is still another object of the present invention to provide a developer container, a developing device, a process cartridge, an image forming apparatus detachably mountable on the process cartridge, and a method in which a developer adhering to light-transmitting windows can be easily removed in order to detect the remaining amount of the developer accommodated within the developer container.

It is yet another object of the present invention to provide a developer container, a developing device, a process cartridge, and an image forming apparatus detachably mountable on the process cartridge, and a method in which power consumption of a light emitting member can be reduced in order to detect the remaining amount of a developer accommodated within the developer container.

It is another object of the present invention to provide a developer container for accommodating a developer used for developing an electrostatic latent image formed on an electrophotographic photosensitive member by means of a developing member for developing the electrostatic latent image. The container includes a first light-transmitting window configured and positioned to guide detection light emitted from a light emitting member provided in a main body of an image forming apparatus into the developer container, in order to detect a remaining amount of the developer accommodated within the developer container when the developer container is mounted in the main body of the image forming apparatus, a second light-transmitting window configured and positioned to guide the detection light entering from the first light-transmitting window and passing through the developer container to a photosensing member provided in the main body of the image forming apparatus, in order to detect the remaining amount of the developer accommodated within the developer container when the developer container is mounted in the main body of the image forming apparatus, and a rotatable feeding member including a stirring blade configured and positioned to feed the developer within the developer container toward the developing member when rotating, and to remove particles of the developer adhering to the first light-transmitting window and the second light-transmitting window by contacting the first light-transmitting window and the second light-transmitting window. At least one of the respective inner surfaces of the first light-transmitting window and the second light-transmitting window facing the inside of the developer container is a circular convex portion, convex along a longitudinal direction of the rotatable feeding member.

It is yet another object of the present invention to provide a developing device for developing an electrostatic latent image formed on an electrophotographic photosensitive member. The device includes a developing member configured and positioned to develop the electrostatic latent image, and a developer container configured and positioned to accommodate a developer used by the developing member. The developer container includes a first light-transmitting window configured and positioned to guide detection light emitted from a light emitting member provided in a main body of an image forming apparatus into the developer container, in order to detect a remaining amount of the developer accommodated within the developer container when the developer container is mounted in the main body of the image forming apparatus, a second light-transmitting window configured and positioned to guide the detection light entering from the first-transparent window and passing through the developer container to a photosensing member provided in the main body of the image forming apparatus, in order to detect the remaining amount of the developer accommodated within the developer container when the developer container is mounted in the main body of the image forming apparatus, and a rotatable feeding member including a stirring blade configured and positioned to feed the developer within the developer container toward the developing member when rotating, and to remove particles of the developer adhering to the first light-transmitting window and the second light-transmitting window by contacting the first light-transmitting window and the second light-transmitting window. At least one of respective inner surfaces of the first light-transmitting window and the second light-transmitting window facing the inside of the developer container is a circular convex portion, convex along a longitudinal direction of the rotatable feeding member.

It is another object of the present invention to provide a process cartridge capable of being detachably mounted in an image forming apparatus. The process cartridge includes an electrophotographic photosensitive member, process means for operating on the electrophotographic photosensitive member, a developing member configured and positioned to develop an electrostatic latent image formed on the electrophotographic photosensitive member, and a developer container configured and positioned to accommodate a developer used by the developing member. The developer container includes a first light-transmitting window configured and positioned to guide detection light emitted from a light emitting member provided in a main body of an image forming apparatus into the developer container, in order to detect a remaining amount of the developer accommodated within the developer container when the process cartridge is mounted in the main body of the image forming apparatus, a second light-transmitting window configured and positioned to guide the detection light entering from the first light-transmitting window and passing through the developer container to a photosensing member provided in the main body of the image forming apparatus, in order to detect the remaining amount of the developer accommodated within the developer container when the process cartridge is mounted in the main body of the image forming apparatus, and a rotatable feeding member including a stirring blade configured and positioned to feed the developer within the developer container toward the developing member when rotating, and to remove particles of the developer adhering to the first light-transmitting window and the second light-transmitting window by contacting the first light-transmitting window and the second light-transmitting window. At least one of the respective inner surfaces of the first light-transmitting window and the second light-transmitting window facing the inside of the developer container is a circular convex portion, convex along a longitudinal direction of the rotatable feeding member.

It is still another object of the present invention to provide an image forming apparatus, capable of detachably mounting a process cartridge, for forming an image on a recording medium. The apparatus includes (i) a main body, (ii) a light emitting member in the main body and configured and positioned to emit detection light, (iii) a photosensing member in the main body and configured and positioned to receive the detection light emitted by the light emitting member, and (iv) mounting means for detachably mounting the process cartridge including an electrostatic photosensitive member, process means for operating on the electrophographic photosensitive member, a developing member configured and positioned to develop an electrostatic latent image formed on the electrostatic photosensitive member, and a developer container configured and positioned to accommodate a developer used by the developing member. The developer container includes a first light-transmitting window configured and positioned to guide detection light emitted from the light emitting member provided in the main body of the image forming apparatus into the developer container, in order to detect a remaining amount of the developer accommodated within the developer container when the process cartridge is mounted in the main body of the image forming apparatus, a second light-transmitting window configured and positioned to guide the detection light, entering from the first light-transmitting window and passing through the developer container, to the photosensing member provided in the main body of the image forming apparatus, in order to detect the remaining amount of the developer accommodated within the developer container when the process cartridge is mounted in the main body of the image forming apparatus, and a rotatable feeding member including a stirring blade configured and positioned to feed the developer within the developer container toward the developing member when rotating, and to remove particles of the developer adhering to the first light-transmitting window and the second light-transmitting window by contacting the first light-transmitting window and the second light-transmitting window. At least one of the respective inner surfaces of the first light-transmitting window and the second light-transmitting window facing the inside of the developer container is a circular convex portion, convex along a longitudinal direction of the rotatable feeding member. The apparatus also comprises (v) conveyance means for conveying the recording medium.

It is another object of the present invention to provide a developer container for accommodating a developer used for developing an electrostatic latent image formed on an electrophotographic photosensitive member by means of a developing member for developing the electrostatic latent image. The developer container comprises first guiding means for guiding detection light emitted from a light emitting member provided in a main body of an image forming apparatus into the developer container, in order to detect a remaining amount of the developer accommodated within the developer container when the developer container is mounted in the main body of the image forming apparatus, second guiding means for guide the detection light entering from said first guiding means and passing through said developer container to a photosensing member provided in the main body of the image forming apparatus, in order to detect the remaining amount of the developer accommodated within the developer container when the developer container is mounted in the main body of the image forming apparatus, and rotatable feeding means for feeding the developer within the developer container toward the developing member when rotating, and for removing particles of the developer adhering to the guiding means and the second guiding means by contacting and wiping the first guiding means and the second guiding means. At least one of the respective inner surfaces of the first guiding means and the second guiding means facing the inside of the developer container comprises concentrating means for concentrating the wiping force of the rotatable feeding means wiping the particles of developer adhering to the concentrating means when the rotatable feeding means contacts the concentrating means. In one embodiment, the first guiding means comprises a first light-transmitting window, the second light-transmitting window comprises a second light-transmitting window, the rotatable feeding means comprises a stirring blade, and the concentrating means comprises a circular convex portion, convex along a longitudinal direction of the rotatable feeding means.

It is another object of the present invention to provide a developing device for developing an electrostatic latent image formed on an electrophotographic photosensitive member. The developing device comprises developing means for developing the electrostatic latent image, and means for accommodating a developer used by said developing means. The accommodating means comprises first guiding means for guiding detection light emitted from a light emitting member provided in a main body of an image forming apparatus into the accommodating means, in order to detect a remaining amount of the developer accommodated within the accommodating means when the accommodating means is mounted in the main body of the image forming apparatus, second guiding means for guiding the detection light, entering from the first guiding means and passing through the accommodating means, to a photosensing member provided in the main body of the image forming apparatus, in order to detect the remaining amount of the developer accommodated within the accommodating means when the accommodating means is mounted in the main body of the image forming apparatus, and rotatable feeding means for feeding the developer within the accommodating means toward the developing means when rotating, and for removing particles of the developer adhering to the first guiding means and the second guiding means by contacting the first guiding means and the second guiding means. At least one of the respective inner surfaces of the first guiding means and the second guiding means facing the inside of the accommodating means comprises concentrating means for concentrating the wiping force of the rotatable feeding means wiping the particles of developer adhering to the concentrating means when the rotatable feeding means contacts the concentrating means. In one embodiment, the first guiding means comprises a first light-transmitting window, the second guiding means comprises a second light-transmitting window, the rotatable feeding means comprises a stirring blade, and the concentrating means comprises a circular convex portion, convex along a longitudinal direction of the rotatable feeding means.

It is yet another object of the present invention to provide a process cartridge capable of being detachably mounted in an image forming apparatus. The process cartridge comprises an electrophotographic photosensitive member, process means for operating on the electrophotographic photosensitive member, developing means for developing an electrostatic latent image formed on the electrophotographic photosensitive member, and accommodating means for accommodating a developer used by the developing means. The accommodating means comprises first guiding means for guiding detection light emitted from a light emitting member provided in a main body of an image forming apparatus into the accommodating means, in order to detect a remaining amount of the developer accommodated within the accommodating means when the process cartridge is mounted in the main body of the image forming apparatus, second guiding means for guiding the detection light entering from the first guiding means and passing through the accommodating means to a photosensing member provided in the main body of the image forming apparatus, in order to detect the remaining amount of the developer accommodated within the accommodating means when the process cartridge is mounted in the main body of the image forming apparatus, and rotatable feeding means for feeding the developer within the accommodating means toward the developing means when rotating, and for removing particles of the developer adhering to the first guiding means and the second guiding means by contacting the first guiding means and the second guiding means. At least one of the respective inner surfaces of the first guiding means and the second guiding means facing the inside of the accommodating means comprises concentrating means for concentrating the wiping force of the rotatable feeding means wiping the particles of developer adhering to the concentrating means when the rotatable feeding means contacts the concentrating means. In one embodiment, the first guiding means comprises a first light-transmitting window, the second guiding means comprises a second light-transmitting window, the rotatable feeding means comprises a stirring blade, and the concentrating means comprises a circular convex portion, convex along a longitudinal direction of the rotatable feeding means.

It is another object of the present invention to provide an image forming apparatus, capable of detachably mounting a process cartridge, for forming an image on a recording medium. The image forming apparatus comprises (i) a main body, (ii) light emitting means in the main body for emitting detection light, (iii) photosensing means in the main body for receiving the detection light emitted by the light emitting means, for sensing the received detection light, and outputting a signal representing the received detection light, (iv) mounting means for detachably mounting the process cartridge comprising an electrostatic photosensitive member, process means for operating on the electrophographic photosensitive member, developing means for developing an electrostatic latent image formed on the electrostatic photosensitive member, and accommodating means for accommodating a developer used by the developing means. The accommodating means comprises first guide means for guiding the detection light emitted from the light emitting means provided in the main body of the image forming apparatus into the accommodating means, in order to detect a remaining amount of the developer accommodated within the accommodating means when the process cartridge is mounted in the main body of the image forming apparatus, second guiding means for guiding the detection light, entering from the first guide means and passing through the accommodating means to the photosensing means provided in the main body of the image forming apparatus, in order to detect the remaining amount of the developer accommodated within the accommodating means when the process cartridge is mounted in the main body of the image forming apparatus, and rotatable feeding means for feed the developer within the accommodating means toward the developing member when rotating, and for removing particles of the developer adhering to the first guiding means and the second guiding means by contacting the first guiding means and the second guiding means. At least one of the respective inner surfaces of the first guiding means and the second guiding means facing the inside of the accommodating means comprises concentrating means for concentrating the wiping force of the rotatable feeding means wiping the particles of developer adhering to the concentrating means when the rotatable feeding means contacts the concentrating means. The apparatus also comprises (v) conveyance means for conveying the recording medium.

It is still another object of the present invention to provide a method of improving the transmission of developer-amount detection light through a developer container for accommodating a developer used for developing an electrostatic latent image formed on an electrophotographic photosensitive member by means of a developing member for developing the electrostatic latent image. The method comprises the steps of guiding developer-amount detection light emitted from a light emitting member provided in a main body of an image forming apparatus into the developer container with first guiding means, in order to detect a remaining amount of the developer accommodated within said developer container when the developer container is mounted in the main body of the image forming apparatus, guiding the developer-amount detection light, emitted from the light emitting member, guided into the developer container, and passing through the developer container, to a photosensing member provided in the main body of the image forming apparatus with second guiding means, in order to detect the remaining amount of the developer accommodated within the developer container when the developer container is mounted in the main body of the image forming apparatus, feeding the developer within the developer container toward the developing member and simultaneously removing particles of the developer adhering to the first guiding means and the second guiding means by wiping the first guiding means and the second guiding means with a wiping force, and concentrating the wiping force wiping the particles of developer adhering to at least one of the respective inner surfaces of the first guiding means and the second guiding means facing the inside of the developer container. In one embodiment, the feeding step comprises the step of rotating feeding means in the developer container and wiping the at least one of the respective inner surfaces of the first guiding means and the second guiding means facing the inside of the developer container with the rotating feeding means. In this embodiment, the feeding means comprises a stirring blade, wherein the at least one of the respective inner surfaces of the first guiding means and the second guiding means facing the inside of the developer container comprises a circular convex portion, convex along a longitudinal direction of the feeding means. In this embodiment, the concentrating step generates a concentrated wiping force by the sliding of the stirring blade against the circular convex portion.

It is yet another object of the present invention to provide a method of detecting the amount of developer in a developer container for accommodating a developer used for developing an electrostatic latent image formed on an electrophotographic photosensitive member by means of a developing member for developing the electrostatic latent image. The method comprises the steps of emitting developer-amount detection light from a light emitting member provided in a main body of an image forming apparatus into the developer container in order to detect a remaining amount of the developer accommodated within the developer container when the developer container is mounted in the main body of the image forming apparatus, guiding the emitted developer-amount detection light into the developer container with first guiding means, in order to detect a remaining amount of the developer accommodated within the developer container when the developer container is mounted in the main body of the image forming apparatus, guiding the developer-amount detection light, emitted from the light emitting member, guided into the developer container, and passing through the developer container, to a photosensing member provided in the main body of the image forming apparatus with second guiding means, in order to detect the remaining amount of the developer accommodated within the developer container when the developer container is mounted in the main body of the image forming apparatus, detecting the amount of developer in the developer container using the sensed developer-amount detection light sensed by the photosensing member, feeding the developer within the developer container toward the developing member and simultaneously removing particles of the developer adhering to the first guiding means and the second guiding means by wiping the first guiding means and the second guiding means with a wiping force, and concentrating the wiping force wiping the particles of developer adhering to at least one of the respective inner surfaces of the first guiding means and the second guiding means facing the inside of the developer container. In one embodiment, the feeding step comprises the step of rotating feeding means in the developer container and wiping the at least one of the respective inner surfaces of the first guiding means and the second guiding means facing the inside of the developer container with the rotating feeding means. In this embodiment, the feeding means comprises a stirring blade, the at least one of the respective inner surfaces of the first guiding means and the second guiding means facing the inside of the developer container comprises a circular convex portion, convex along a longitudinal direction of the feeding means, and the concentrating step generates a concentrated wiping force by the sliding of the stirring blade against the circular convex portion.

It is still another object of the present invention to provide a method of feeding a developer to a developing member for developing an electrostatic latent image formed on an electrophotographic photosensitive member. The method comprises the steps of feeding developer within a developer container toward a developing member and simultaneously removing particles of the developer: (i) adhering to first guiding means for guiding developer-amount detection light emitted from a light emitting member into the developer container, when the developer container is mounted in a main body of an image forming apparatus, by wiping the first guiding means with a wiping force, and (ii) adhering to second guiding means for guiding the developer-amount detection light, emitted from the light emitting member, guided into the developer container by the first guiding means, and passing through the developer container, to a photosensing member, when the developer container is mounted in the main body of the image forming apparatus, by wiping the second guiding means with a wiping force. The method also comprises the step of concentrating the wiping force wiping the particles of developer adhering to at least one of the respective inner surfaces of the first guiding means and the second guiding means facing the inside of the developer container. In one embodiment, the feeding step comprises the step of rotating feeding means in the developer container and wiping the at least one of the respective inner surfaces of the first guiding means and the second guiding means facing the inside of the developer container with the rotating feeding means. In this embodiment, the feeding means comprises a stirring blade, the the at least one of the respective inner surfaces of the first guiding means and the second guiding means facing the inside of the developer container comprises a circular convex portion, convex along a longitudinal direction of the feeding mean, and the concentrating step generates a concentrated wiping force by the sliding of a stirring blade against the circular convex portion.

It is yet another object of the present invention to provide a method of developing an electrostatic latent image formed on an electrophotographic photosensitive member by means of a developing member for developing the electrostatic latent image. The method comprises the steps of feeding developer within a developer container toward a developing member and simultaneously removing particles of the developer: (i) adhering to first guiding means for guiding developer-amount detection light emitted from a light emitting member into the developer container, when the developer container is mounted in a main body of an image forming apparatus, by wiping the first guiding means with a wiping force, and (ii) adhering to second guiding means for guiding the developer amount detection light, emitted from the light emitting member, guided into the developer container by the first guiding means, and passing through the developer container, to a photosensing member, when the developer container is mounted in the main body of the image forming apparatus, by wiping the second guiding means with a wiping force. The method also comprises the step of concentrating the wiping force wiping the particles of developer adhering to at least one of the respective inner surfaces of the first guiding means and the second guiding means facing the inside of the developer container, and applying, with the developing member, the developer fed to the developing member to the electrophotographic photosensitive member having the electrostatic latent image formed thereon to develop the electrostatic latent image. In one embodiment, the feeding step comprises the step of rotating feeding means in the developer container and wiping the at least one of the respective inner surfaces of the first guiding means and the second guiding means facing the inside of the developer container with the rotating feeding means. In this embodiment, the feeding means comprises a stirring blade, the at least one of the respective inner surfaces of the first guiding means and the second guiding means facing the inside of the developer container comprises a circular convex portion, convex along a longitudinal direction of the feeding means, and the concentrating step generates a concentrated wiping force by the sliding of a stirring blade against the circular convex portion.

The foregoing and other objects, advantages and features of the present invention will become more apparent from the following detailed description of the preferred embodiment taken in conjunction with the accompanying drawings.

BRIEF DESCRIPTION OF THE DRAWINGS

FIGS. 9A-9D show a front view, two side views and a back view of a light guide provided at a side where light enters;

FIGS. 10A-10D show a front view, two side views and a back view of a light guide provided at a side where light leaves;

DETAILED DESCRIPTION OF THE PREFERRED EMBODIMENT

A description will now be provided of a preferred embodiment of the present invention applied to a developing device, a process cartridge, a full-color laser-beam printer, serving as an image forming apparatus, and a method of improving the transmission of a developer-amount detection light through a developer container, a method of detecting the amount of developer in a developer container, a method of feeding a developer to a developer member, and a method of developing an electrostatic latent image formed on an electrophotographic photosensitive member.

A description will now be provided of a case in which an electrophotographic multicolor image forming apparatus is used as the image forming apparatus of the embodiment, with reference to FIGS. 1-12. An electrophotographic image forming apparatus forms an image on a recording medium according to an electrophotographic image forming method.

For example, the electrophotographic image forming apparatus comprises an electrophotographic copier, an electrophotographic printer (such as a laser-beam printer, an LED (light-emitting diode) printer, or the like), a facsimile apparatus, a word processor, or the like.

The process cartridge integrates charging means, developing means, cleaning means, and an electrophotographic photosensitive drum, serving as an electrophotographic photosensitive member, so as to be detachably mountable in the main body of the image forming apparatus.

In another configuration, the process cartridge integrates at least one of charging means, developing means and cleaning means, and an electrophotographic photosensitive drum, so as to be detachably mountable in the main body of the image forming apparatus.

In still another configuration, the process cartridge integrates at least developing means and an electrophotographic photosensitive drum, so as to be detachably mountable in the main body of the image forming apparatus.

ENTIRE CONFIGURATION OF THE IMAGE FORMING APPARATUS

Figure 1:
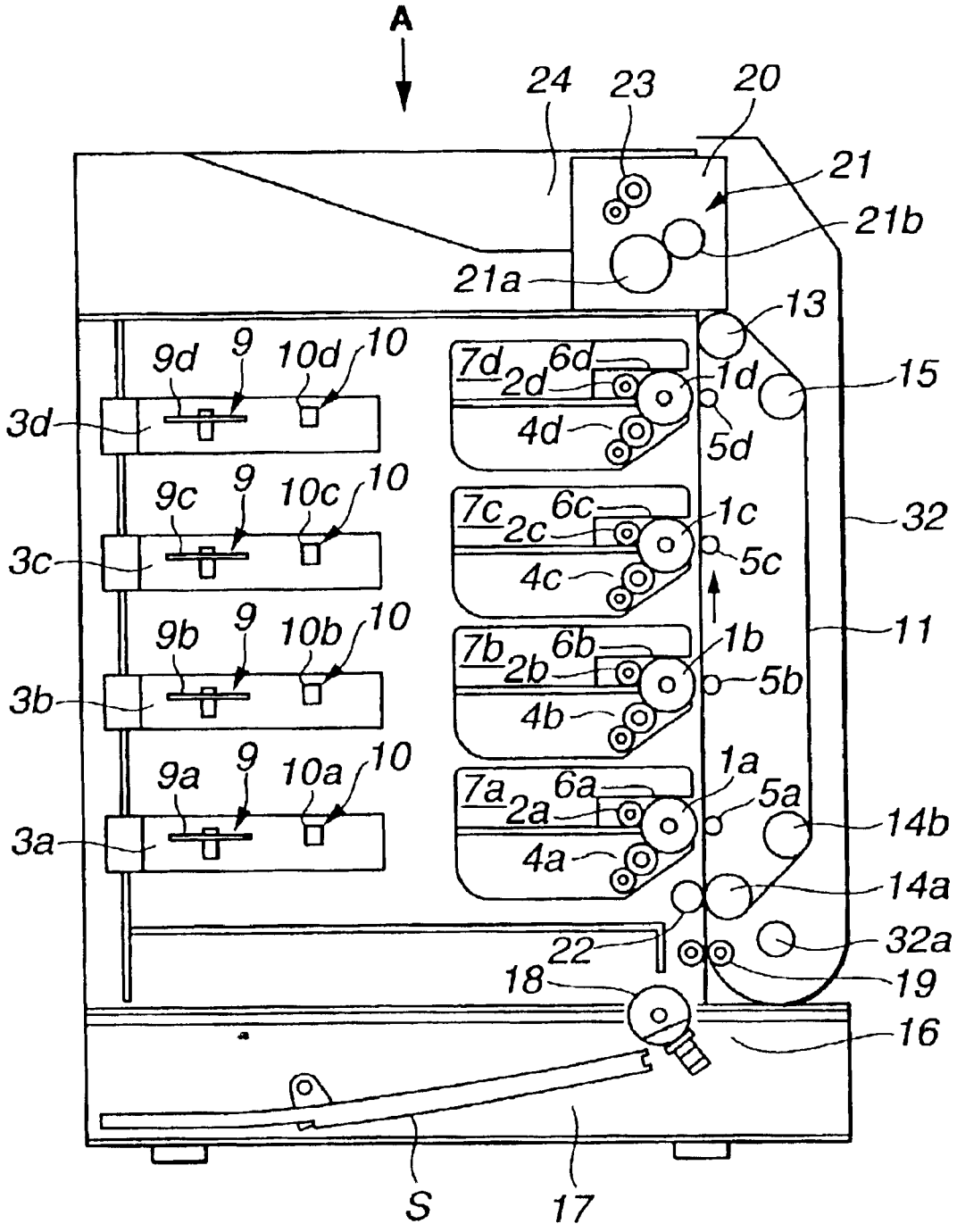
FIGS. 1 and 2 are schematic cross-sectional views illustrating the configuration of an image forming apparatus according to an embodiment of the present invention.
Figure 2:
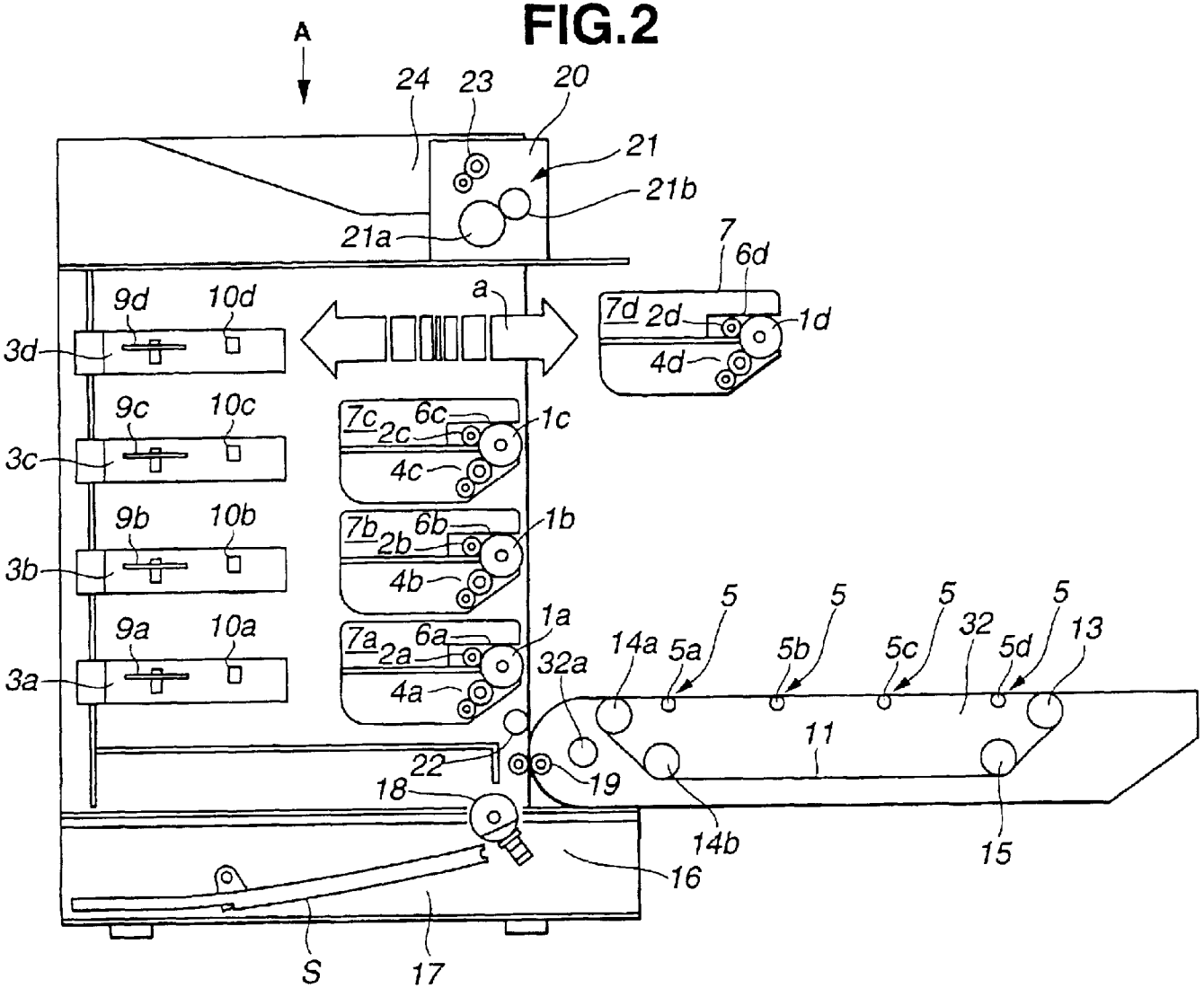
Figure 3:
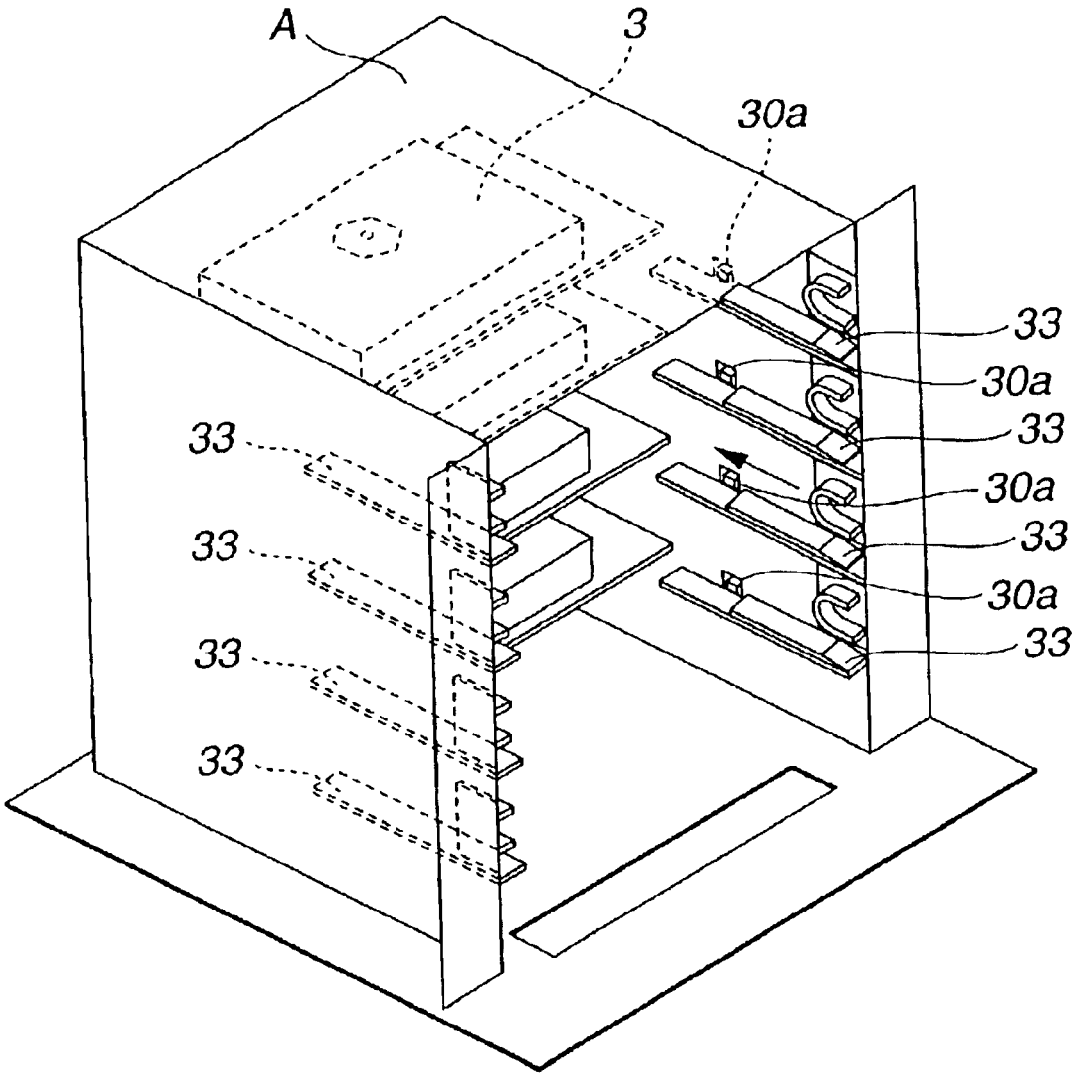
FIG. 3 is a perspective view illustrating the configuration of the main body of the image forming apparatus shown in FIGS. 1 and 2.

First, an outline of the entire configuration of the image forming apparatus will be described with reference to FIGS. 1-3. FIGS. 1-3 illustrate the entire configuration of the full-color laser-beam printer, serving as a multicolor image forming apparatus.

The image forming apparatus A shown in FIGS. 1-3 has four integrated process cartridges 7*a*, 7*b*, 7*c* and 7*d* detachably mountable to an electrophotographic image forming apparatus. When a particular integrated process cartridge is discussed, it may be generically referred to as a process cartridge 7. The elements of the four integrated process cartridges comprise, respectively, photosensitive drums 1*a*, 1*b*, 1*c* and 1*d*, charging rollers 2*a*, 2*b*, 2*c* and 2*d*, developing devices 4*a*, 4*b*, 4*c* and 4*d*, and cleaning devices 6*a*, 6*b*, 6*c* and 6*d*. When a particular drum, a charging roller, a developing device, and a cleaning device is discussed, it may be generically referred to as photosensitive drum 1, a charging roller 2, a developing device 4, and a cleaning device 6, respectively. Similarly, the electrophotographic image forming apparatus comprises four scanner units 3*a*, 3*b*, 3*c* and 3*d*, four transfer rollers 5*a*, 5*b*, 5*c* and 5*d*, four polygonal mirrors 9*a*, 9*b*, 9*c* and 9*d*, and four imaging lenses 10*a*, 10*b*, 10*c* and 10*d*, but when one of these elements is discussed, it may be generically referred to as scanner unit 3, transfer roller 4, polygonal mirror 9, and imaging lens 10, respectively. As noted above, the image forming apparatus A has four photosensitive drums 1 (1*a*, 1*b*, 1*c*, 1*d*), each serving as an image bearing member, arranged in a vertical direction, one above the other. The photosensitive drum 1 is rotatably driven in a counterclockwise direction in FIG. 1 by driving means (not shown).

Around the photosensitive drum 1, a charging roller 2 (2*a*, 2*b*, 2*c*, 2*d*), for uniformly charging the surface of the photosensitive drum 1, a scanner unit 3 (3*a*, 3*b*, 3*c*, 3*d*) for forming an electrostatic latent image on the surface of the uniformly charged photosensitive drum 1 by projecting laser-beam based image information, a developing device 4 (4*a*, 4*b*, 4*c*, 4*d*) for developing the electrostatic latent image formed by the scanner unit 3 on the photosensitive drum 1 by causing a toner T, serving as a developer, to adhere to the photosensitive drum 1, to provide a toner image, a transfer roller 5 (5*a*, 5*b*, 5*c*, 5*d*) for transferring the toner image on the photosensitive drum 1 onto a transfer material S, serving as a recording medium, a cleaning device 6 (6*a*, 6*b*, 6*c*, 6*d*) for removing particles of the toner T remaining on the surface of the photosensitive drum 1 after image transfer, and the like are disposed in the sequence of the direction of rotation of the photosensitive drum 1.

The photosensitive drum 1, the charging roller 2, the developing device 4 and the cleaning device 6 constitute an integrated process cartridge 7 (7*a*, 7*b*, 7*c*, 7*d*), so as to be detachably mounted in the main body of the image forming apparatus A.

The photosensitive drum 1 is obtained, for example, by coating an OPC (organic photoconductor) photosensitive material on an outer circumferential surface of an aluminum cylinder having a diameter of 30 mm.

Both end portions of the photosensitive drum 1 are rotatably supported by supporting members (not shown). By transmission of a driving force from a driving motor (not shown) to one end portion of the photosensitive drum 1, the photosensitive drum 1 is rotatably driven in a counterclockwise direction in FIG. 1.

Charging means of a contact charging type can be used for charging the surface of the photosensitive drum 1. The charging means of this embodiment is the conductive charging roller 2 having the shape of a roller. By contacting the charging roller 2 to the surface of the photosensitive drum 1 and applying a charging bias voltage to the charging roller 2, the surface of the photosensitive drum 1 is uniformly charged.

The scanner unit 3 is disposed in a substantially horizontal direction with respect to the photosensitive drum 1. Image light corresponding to an image signal emitted from a laser diode (not shown) is projected onto a polygonal mirror 9 (9*a*, 9*b*, 9*c*, 9*d*) rotated at a high speed by a scanner motor (not shown).

The image light reflected by the polygonal mirror 9 selectively exposes the surface of the charged photosensitive drum 1 via an imaging lens 10 (10*a*, 10*b*, 10*c*, 10*d*) to form an electrostatic latent image on the drum 1.

Figure 4:
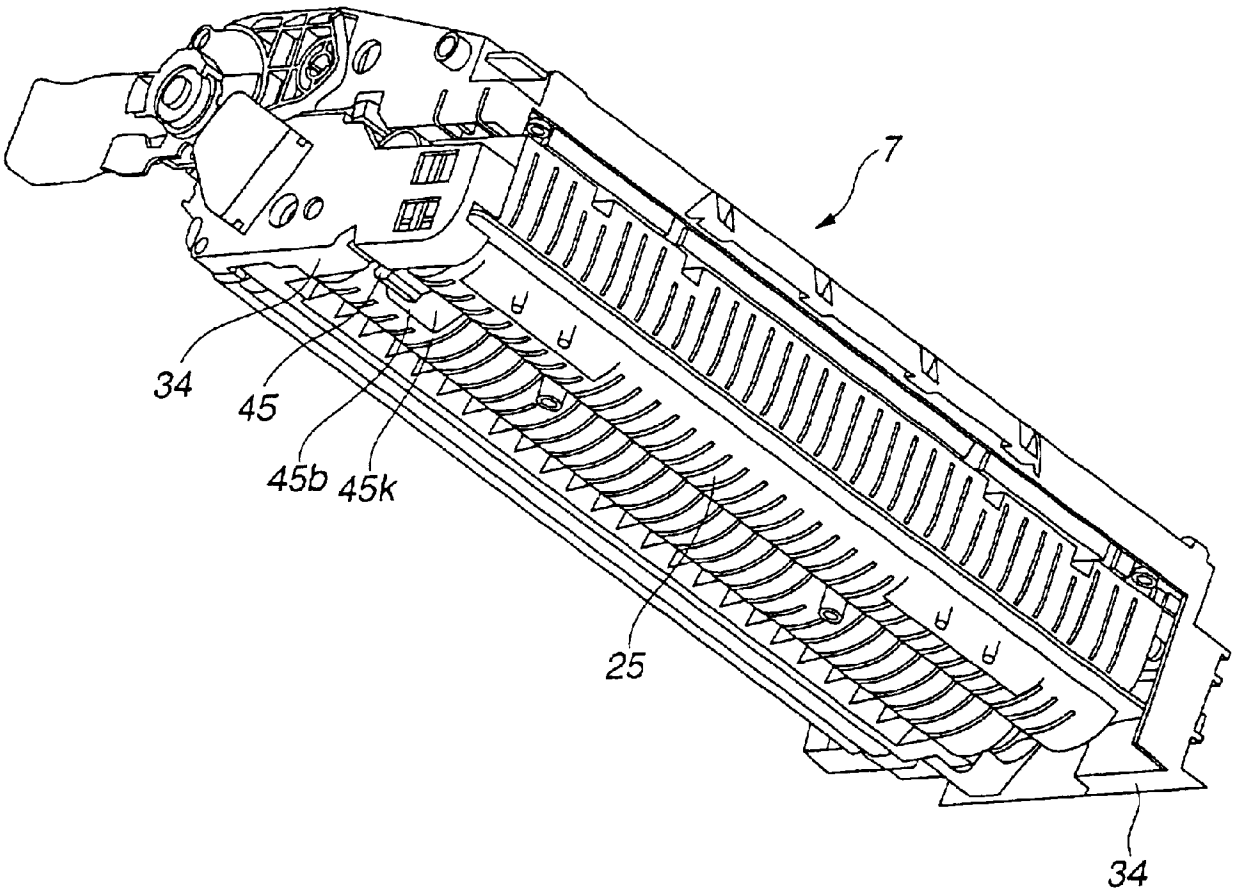
FIG. 4 is a perspective view illustrating the configuration of a process cartridge according to the embodiment.
Figure 5:
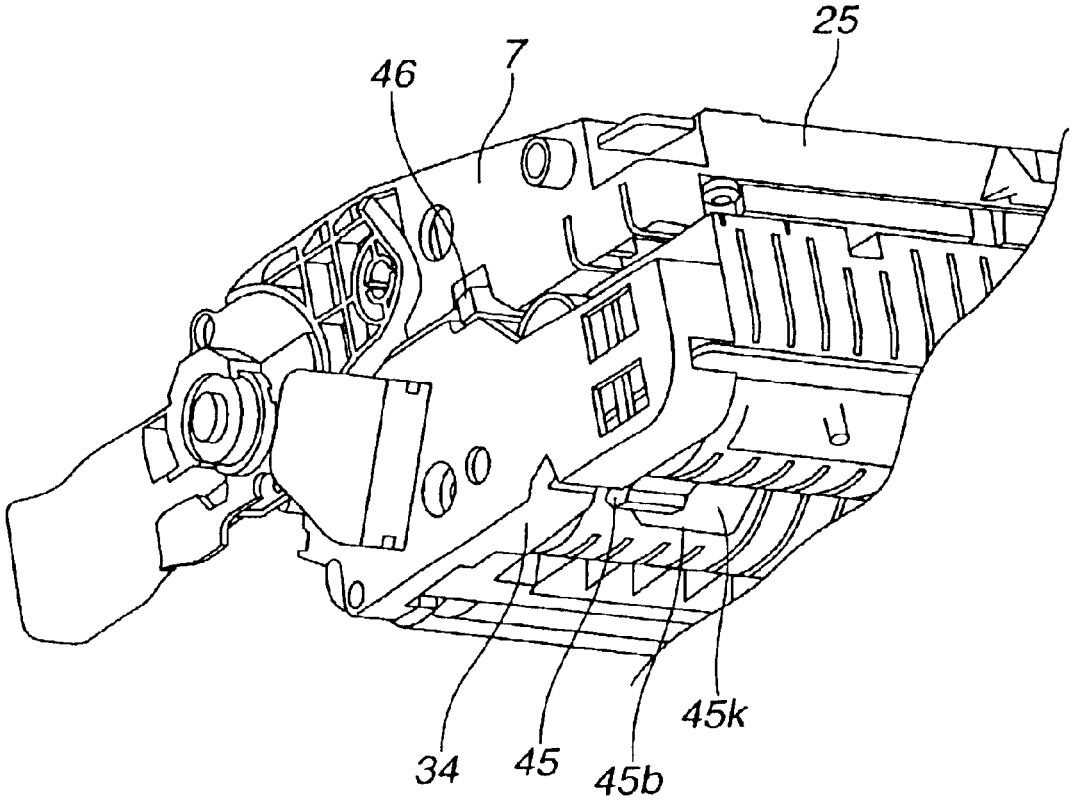
FIG. 5 is a partial enlarged view illustrating the configuration of a portion of the process cartridge shown in FIG. 4.
Figure 6:
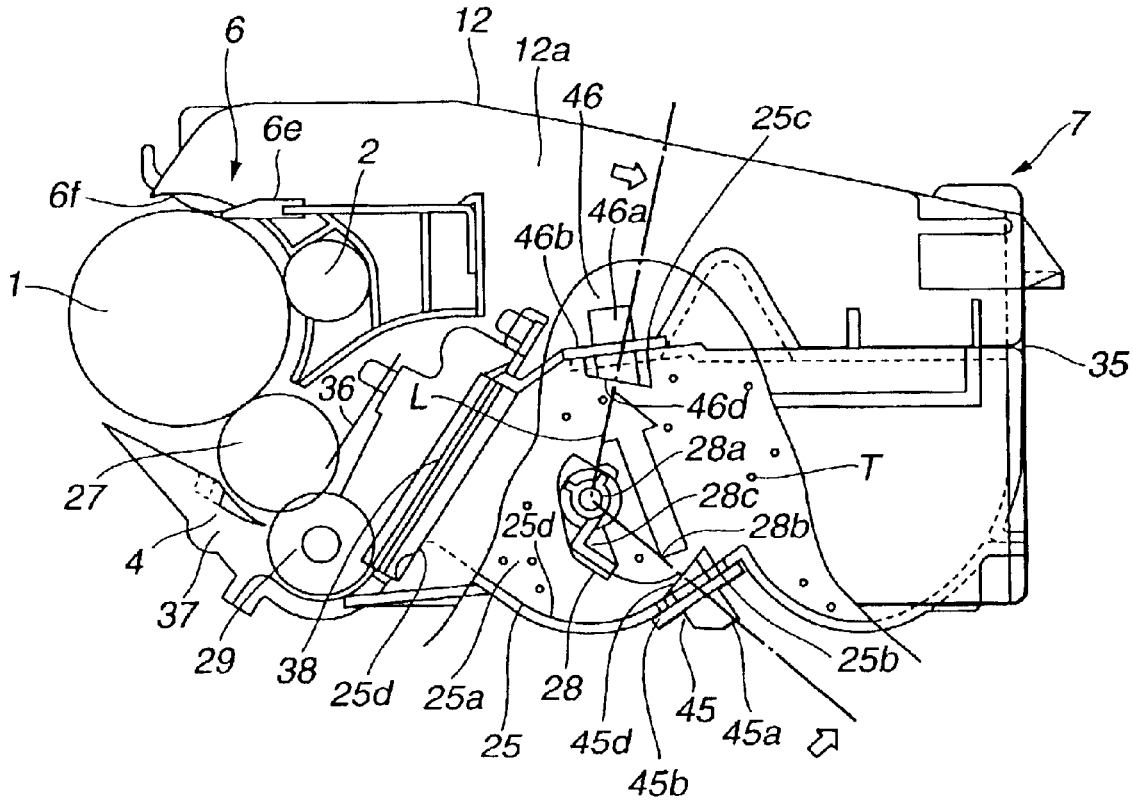
FIG. 6 is a schematic cross-sectional view illustrating the configuration of the process cartridge shown in FIG. 4.

The developing device 4 includes a developer container 25, shown in FIG. 4, having a developer accommodating portion 25*a*, shown in FIG. 6, formed therein that accommodates a toner T of a corresponding color of yellow, magenta, cyan and black. In other words, the developer accommodating portion 25*a* of developer accommodating portion 25*a* of developing device 4*a* associated with the drum 1*a*, accommodates yellow toner, the developer accommodating portion 25*a* of developing device 4*b* associated with the drum 1*b*, accommodates magenta toner, the developer accommodating portion 25*a* of developing device 4*c* associated with the drum 1*c*, accommodates cyan toner, the developer accommodating portion 25*a* of developing device 4*d* associated with the drum 1*d*, accommodates black toner.

An electrostatic transfer belt 11 circulating so as to face and contact each of the photosensitive drums 1*a*-1*d* is provided. The electrostatic transfer belt 11 is made of a film-shaped material having a volume resistivity of $10^{11}$-$10^{14}$ Ω·cm and a thickness of about 150 μm.

The electrostatic transfer belt 11 is supported in a vertical direction by four shafts, i.e., a driving roller 13, driven rollers 14*a* and 14*b*, and a tension roller 15, and circulates so as to cause a transfer material S, serving as a recording medium, to contact each of the photosensitive drums 1*a*-1*d*, one after the other, while electrostatically attracting the transfer material S on a left-side outer circumferential surface of the electrostatic transfer belt 11. Thus, the transfer material S is conveyed to a transfer position facing each of the photosensitive drums 1*a*-1*d* by the electrostatic transfer belt 11, and the toner image on each of the photosensitive drums 1*a*-1*d* is transferred onto the transfer material S, one after the other.

The transfer rollers 5*a*-5*d* are arranged so as to contact the inner side of the electrostatic transfer belt 11 and face the photosensitive drums 1*a*-1*d*, respectively. Positive charges are supplied from the transfer roller 5 to the transfer material S via the electrostatic transfer belt 11, and a negative-polarity toner image on the photosensitive drum 1 is transferred onto the transfer material S that contacts the photosensitive drum 1.

The electrostatic transfer belt 11 has a circumferential length of about 700 mm and a thickness of 150 μm, and rotates in the direction of an arrow shown in FIG. 1 while being stretched around the driving roller 13, the driven rollers 14*a* and 14*b*, and the tension roller 15. Toner images of the respective colors are transferred onto the transfer material S while the transfer material S is conveyed from a portion facing the driven roller 14*a* to a portion facing the driving roller 13 by circulation of the electrostatic transfer belt 11.

A transfer-material feeding unit 16 feeds the transfer material S to an image forming portion. A plurality of sheets of the transfer material S are accommodated within a feeding cassette 17. During an image forming operation, a half-moon feeding roller 18 and a pair of registration rollers 19 are rotatably driven in accordance with the image forming operation. Thus, sheets of the transfer material S within the feeding cassette 17 are individually fed. The leading edge of the transfer material S contacts the stationary pair of registration rollers 19. The transfer material S is further fed to the feeding roller 18 to form a loop. When a predetermined amount of loop is formed, the transfer material temporarily stops. Then, the transfer material S is fed to the electrostatic transfer belt 11 by the pair of registration rollers 19 in synchronization with the rotation of the electrostatic transfer belt 11 and a position to start to record an image.

A fixing unit 20 fixes a toner image of a plurality of colors transferred onto the transfer material S, and includes a pair of fixing rollers 21, comprising a rotating heating roller 21*a*, and a pressing roller 21*b* for supplying the transfer material S with heat and pressure in pressure contact therewith.

That is, when passing through the fixing unit 20, the transfer material S to which the toner image on the photosensitive drum 1 has been transferred is conveyed by the pair of fixing rollers 21, and receives heat and pressure by the pair of fixing rollers 21. Thus, a toner image of a plurality of colors is fixed on the surface of the transfer material S.

During the image forming operation, the process cartridges 7*a*-7*d* are sequentially driven in synchronization with a printing timing, and the photosensitive drums 1*a*-1*d* are rotatably driven in a counterclockwise direction in FIG. 1 in accordance with the printing driving. The scanner units 3 corresponding to the process cartridges 7 are sequentially driven.

According to this driving, the charging roller 2 supplies the circumferential surface of the photosensitive drum 1 with uniform charges. The scanner unit 3 forms an electrostatic latent image on the circumferential surface of the photosensitive drum 1 by exposing it in accordance with an image signal.

A developing roller 27 within the developing device 4 shown in FIG. 6 develops the electrostatic latent image by transferring the toner T to low-potential portions of the electrostatic latent image, to form a toner image on the circumferential surface of the photosensitive drum 1. The developing roller 27 is a developing member for supplying the toner T, serving as a developer, accommodated within the developer container 25, serving as a developer accommodating unit, of the developing device 4 to the photosensitive drum 1, in order to develop the electrostatic latent image formed on the photosensitive drum 1, serving as an image bearing member.

At the time that the leading edge of the toner image on the circumferential surface of the photosensitive drum 1*a* disposed at the most upstream side in the direction of rotation of the electrostatic transfer belt 11 is rotatably conveyed to a position facing the electrostatic transfer belt 11, the pair of registration rollers 19 start rotation to feed the transfer material S to the electrostatic transfer belt 11, so that a position on the transfer material S at which printing will be started coincides with the facing position of the toner image on the drum 1*a*.

The transfer material S is brought in pressure contact with the outer circumference of the electrostatic transfer belt 11 in a state of being grasped between an electrostatic attraction roller 22 and the electrostatic transfer belt 11. By applying a voltage between the electrostatic transfer belt 11 and the electrostatic attraction roller 22, electric charges are induced in dielectric layers of the transfer material S and the electrostatic transfer belt 11 that are dielectric materials, to electrostatically attract the transfer material S onto the outer circumference of the electrostatic transfer belt 11. Thus, the transfer material S is stably attracted on the electrostatic transfer belt 11, and is conveyed to a transfer portion at the most downstream side of the transfer belt 11.

While conveying the transfer material S in the above-described manner, toner images formed on the respective photosensitive drums 1*a*-1*d* are sequentially transferred onto the transfer material S by electric fields formed between the photosensitive drums 1*a*-1*d* and the transfer rollers 5*a*-5*d*, respectively.

The transfer material S having a four-color toner image transferred thereon is separated from the electrostatic transfer belt 11 by the curvature of the driving roller 13 and is conveyed to the fixing unit 20. After fixing the toner image on the transfer material S by the fixing unit 20 using heat, the transfer material S is discharged outside of the main body of the apparatus from a discharge portion 24 by a pair of discharge rollers 23 in a state in which the image surface is placed downward. (Configuration of mounting/detaching of the process cartridge)

Next, a description will be provided of a method for mounting/detaching the process cartridge 7 with respect to the main body of the image forming apparatus A. As shown in FIG. 2, the process cartridge 7 can be detachably mounted in the main body of the image forming apparatus A. The process cartridge 7 is mounted/detached in a horizontal direction in a state in which a front door 32 of the main body of the image forming apparatus is open. The front door 32 rotates around a shaft 32*a* with respect to the main body of the image forming apparatus A to assume a vertically raised state and a horizontally laid and opened state as shown in FIGS. 1 and 2, respectively.

The electrostatic transfer belt 11, and the driving roller 13, the driven rollers 14*a* and 14*b*, the tension roller 15 that support the electrostatic transfer belt 11, and the transfer rollers 5*a*-5*d* are provided in the front door 32.

As shown in FIGS. 3 and 4, each pair of guide rail units 33 operate as mounting means for detachably mounting each process cartridge 7 that is provided within the main body of the image forming apparatus A. By engagement of a pair of guide rail units 33 and insertion guide portions 34, also serving as mounting means, provided on the process cartridge 7, the process cartridge 7 is mounted/detached in the directions of a two-headed arrow "a" (horizontal directions), shown in FIG. 2.

When inserting the process cartridge 7 into the main body of the image forming apparatus A, the process cartridge 7 is pushed to the rear side along the pair of guide rail units 33 in a state in which the front door 32 is open, and stops at a position where the photosensitive drums 1 of the respective process cartridges 7 are arranged along a vertical straight line. When detaching the process cartridge 7, the process cartridge 7 is taken outside of the main body of the image forming apparatus A by being drawn from the mounted position toward the front door 32 along the pair of guide rail units 33.

The process cartridge 7 includes an electrophotographic photosensitive member and at least one process means. The process means comprises, for example, charging means for charging the electrophotographic photosensitive member, developing means for developing a latent image formed on the electrophotographic photosensitive member, cleaning means for cleaning the toner T remaining on the surface of the electrophotographic photosensitive member, and the like.

As shown in FIG. 6, in the process cartridge 7 of the embodiment, the photosensitive drum 1, serving as the electrophotographic photosensitive member, having a photosensitive layer thereon is rotated, and the surface of the photosensitive drum 1 is uniformly charged by applying a voltage to the charging roller 2, serving as charging means. An optical image from the scanner unit 3 is projected onto the charged photosensitive drum 1 via an exposure aperture 35 to form an electrostatic latent image on the surface of the photosensitive drum 1, and the formed electrostatic latent image is developed by the developing device 4, serving as developing means.

As shown in FIG. 6, in the developing device 4, the toner T is fed via an opening 25*d* by a rotatable rotating feeding member 28, serving as toner feeding means, within the developer accommodating portion 25*a* of the developer container 25. Particles of the toner T that have not contributed to development are scraped by a rotatably driven supply roller 29, and always fresh particles of the toner T are supplied to the developing roller 27.

A toner layer having charges generated by frictional electrification by a developing blade 36 is formed on the surface of the developing roller 27 by rotating the developing roller 27. A toner image is formed by transferring the toner T onto the photosensitive drum 1 in accordance with the electrostatic latent image.

A stirring blade 28*b* comprising a flexible sheet made of a plastic material or the like is provided on a boss 28*c* fixed on a shaft 28*a* of the rotating feeding member 28. The shaft 28*a* is rotatably supported in the developer container 25, and one end of the shaft 28*a* extends outside of the developer container 25.

When the process cartridge 7 is in an unused state, the opening 25*d* is sealed by a toner sealing member 38, so that the toner within the developer container 25 does not leak to the outside. The opening 25*d* is opened by drawing the toner sealing member 38 to the outside. A process cartridge 7 using a black magnetic toner T does not have the supply roller 29, serving as a coating roller. The developing roller 27 incorporates a fixed magnet.

After transferring the toner image onto the transfer material S by applying a voltage having a polarity inverse to the polarity of the toner image to the transfer rollers 5*a*-5*d*, particles of the toner T remaining on the photosensitive drum 1 are scraped by a cleaning blade 6*e* provided in the cleaning device 6. Particles of the toner T remaining on the photosensitive drum 1 are also scraped by a scraping sheet 6*f* and are removed by cleaning means (not shown) for collecting the scraped particles in a removed-toner accommodating portion 12*a* of a cleaning container 12.

The process cartridge 7 includes the photosensitive drum 1, the charging roller 2, and the cleaning container 12 that supports the cleaning blade 6*e* and includes the removed-toner accommodating portion 12*a*.

A toner developing frame is obtained by performing ultrasonic welding of a developing container 37 supporting the developing roller 27 and the supply roller 29, and the developer container 25 supporting the rotating feeding member 28 for stirring the toner T and feeding the toner T to the developing container 37. The toner developing frame and the cleaning container 12 supporting the above-described members are rotatably connected by unillustrated means, and a spring (not shown) whose spring force operates so as to bring the photosensitive drum 1 and the developing roller 27 in pressure contact is provided between the developing container 37 and the cleaning container 12.

The developer container 25, the developing container 37 and the cleaning container 12 are made of HIPS (high impact polystyrene).

Next, a description will be provided of a light transmitting toner-remaining-amount detection method that is a feature of the present invention, with reference to FIG. 6. Openings 25*b* and 25*c* are provided in the developer container 25 of the process cartridge 7 accommodating the toner T. The opening 25*b* is provided at a lower portion of the developer container 25, and the opening 25*c* is provided at an upper portion of the developer container 25.

The rotating feeding member 28, serving as a first stirring member, and a second stirring member (not shown) are provided sequentially from a side close to the developing roller 27 within the developer container 25. By the rotation of these stirring members, the toner T is conveyed to the supply roller 29. In addition to conveying the toner T, the rotating feeding member 28 also has a wiping function of removing the toner T adhering to light guides 45 and 46.

Figure 7:
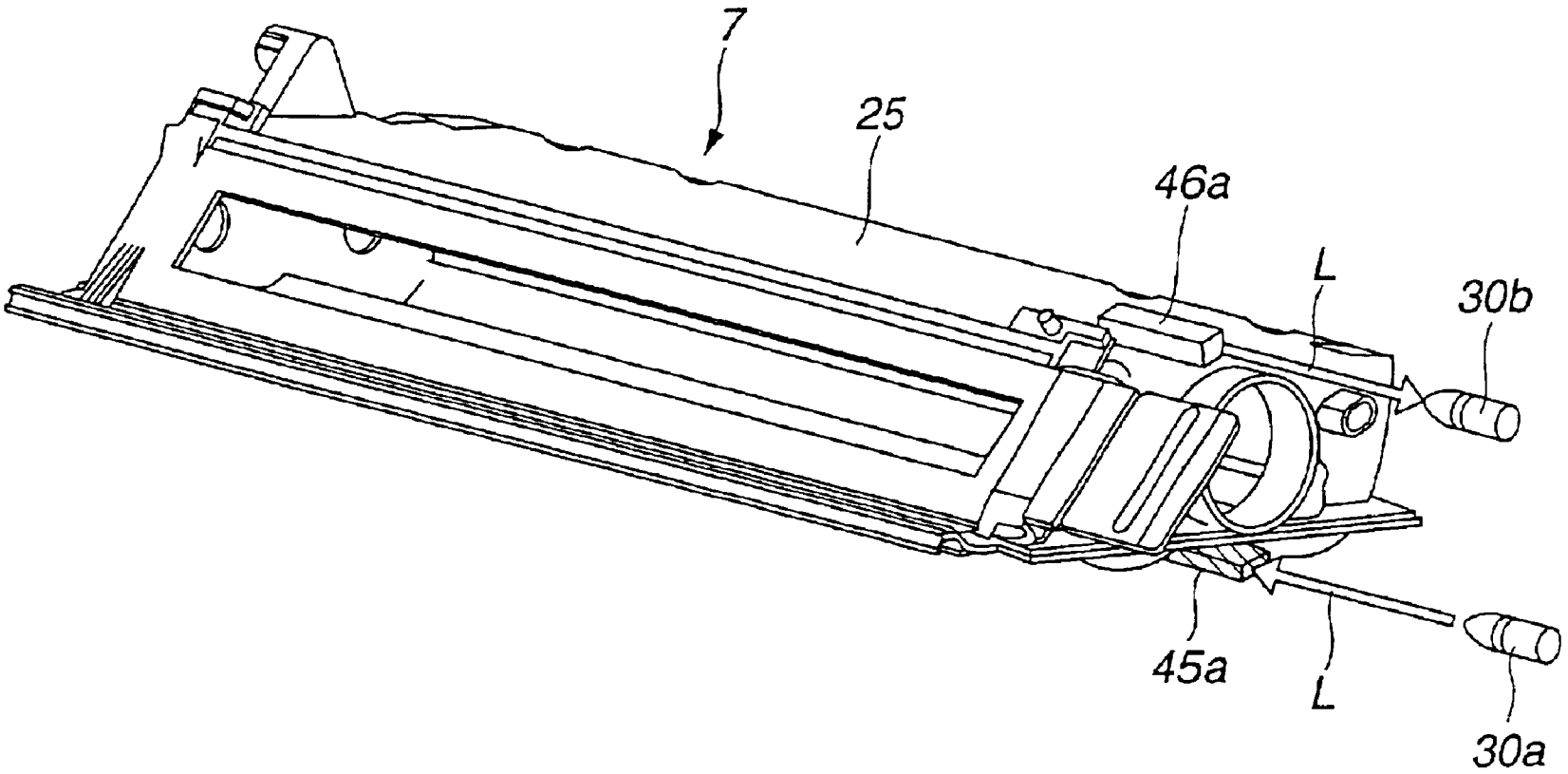
FIG. 7 is a perspective view of a portion of the main assembly of the image forming apparatus and the process cartridge illustrating the positional relationship between the process cartridge, and a light emitting unit and a photosensing unit provided in the main body of the image forming apparatus.
Figure 8:
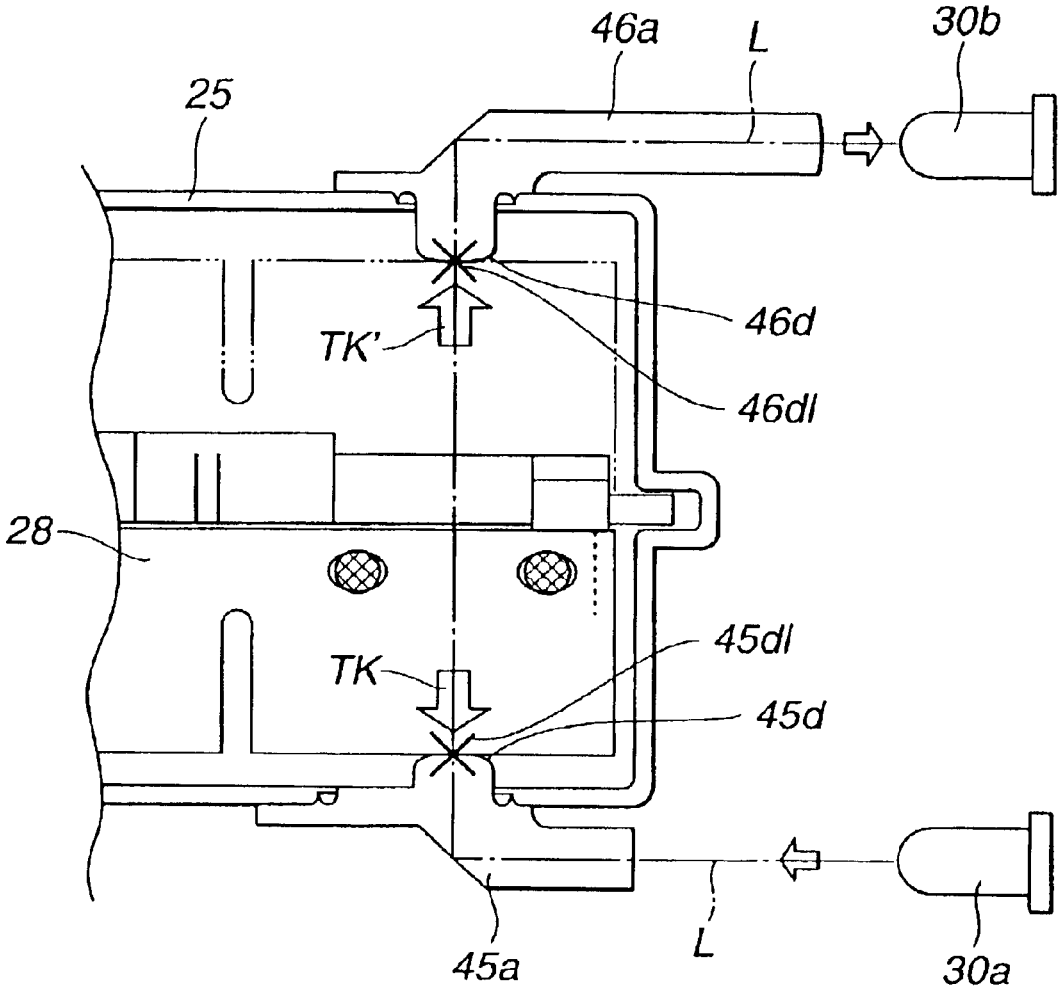
FIG. 8 is a schematic diagram illustrating the positional relationship between light guides provided in the process cartridge, and the light emitting unit and the photosensing unit provided in the main body of the image forming apparatus.
Figure 11:
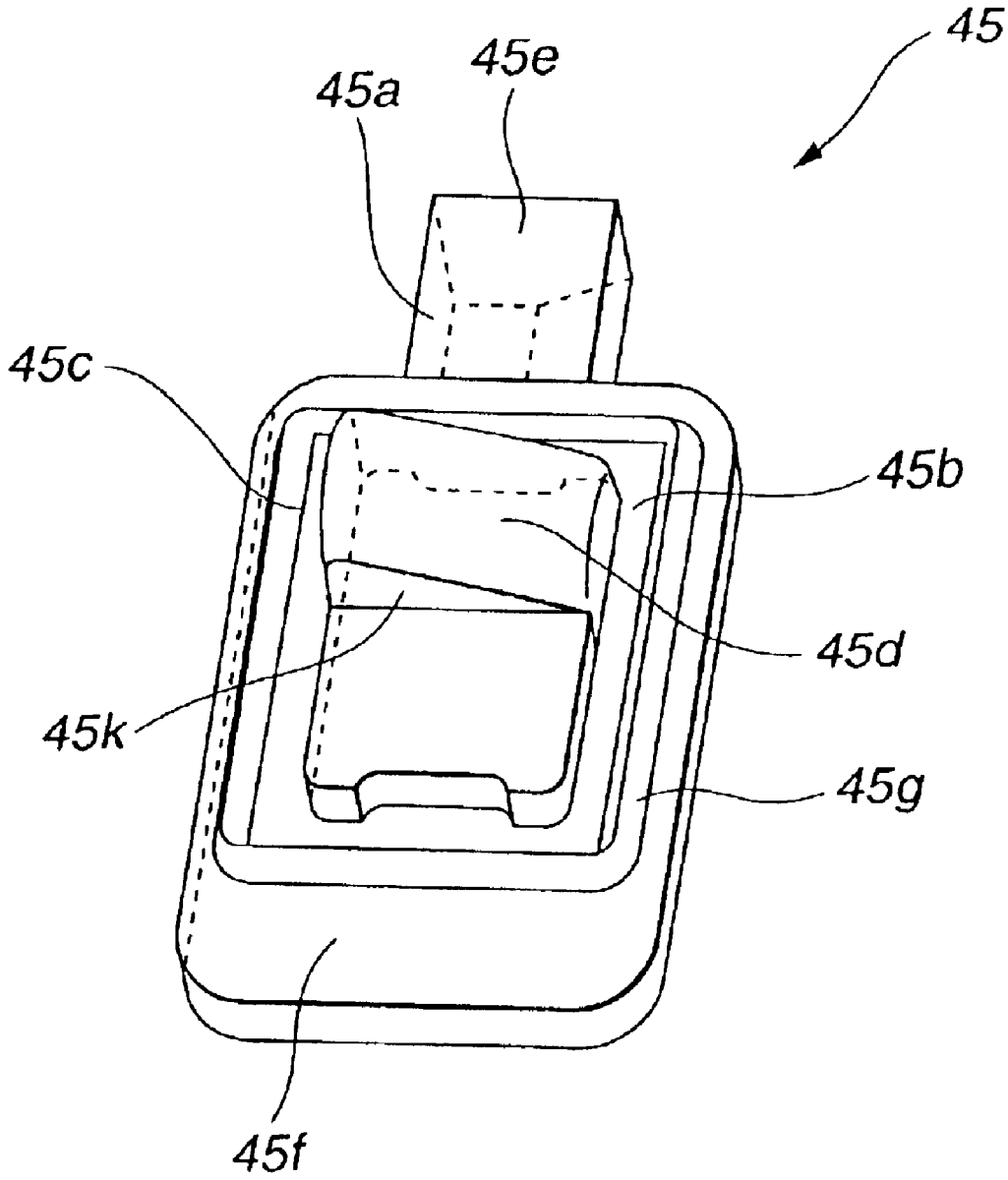
FIG. 11 is a perspective view illustrating the configuration of a light-transmitting window provided at the side where light enters.
Figure 12:
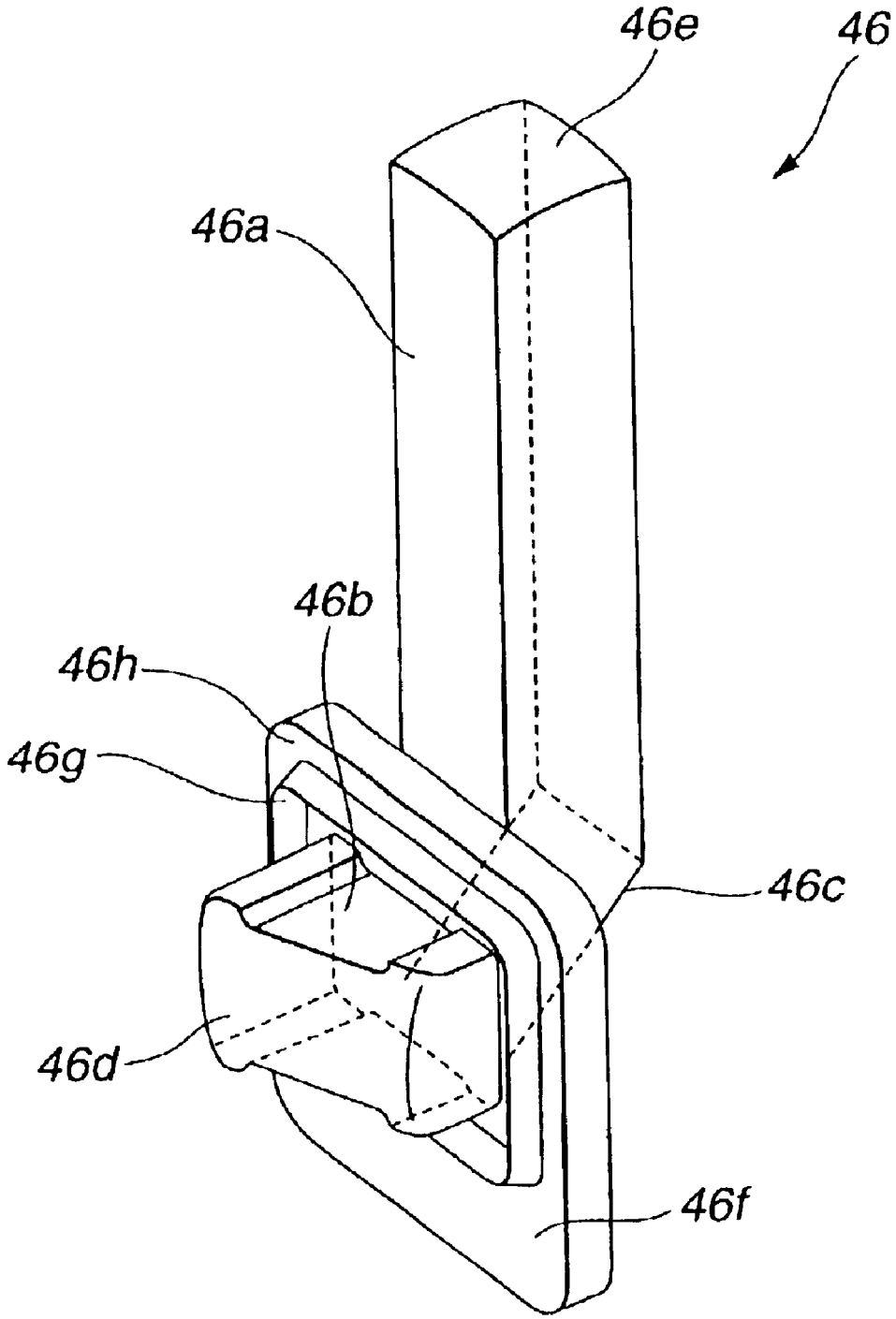
FIG. 12 is a perspective view illustrating the configuration of a light-transmitting window provided at the side where light leaves.
Figure 13:
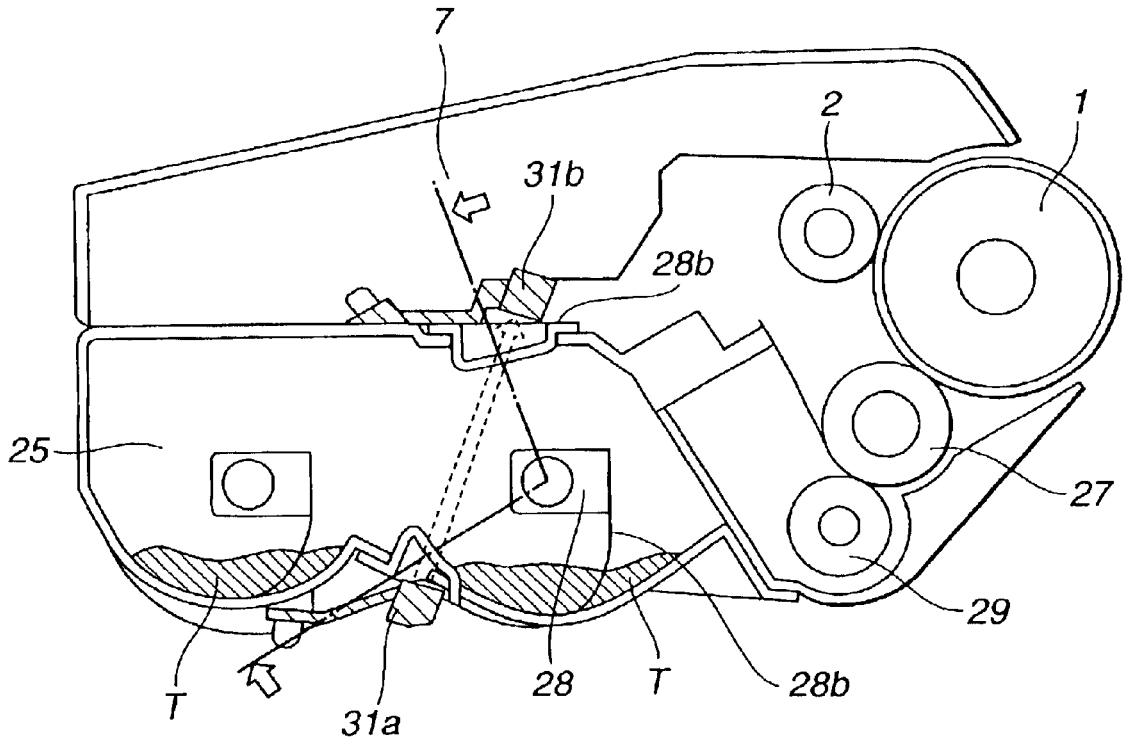
FIGS. 13 and 14 are schematic diagrams illustrating a conventional approach.
Figure 14:
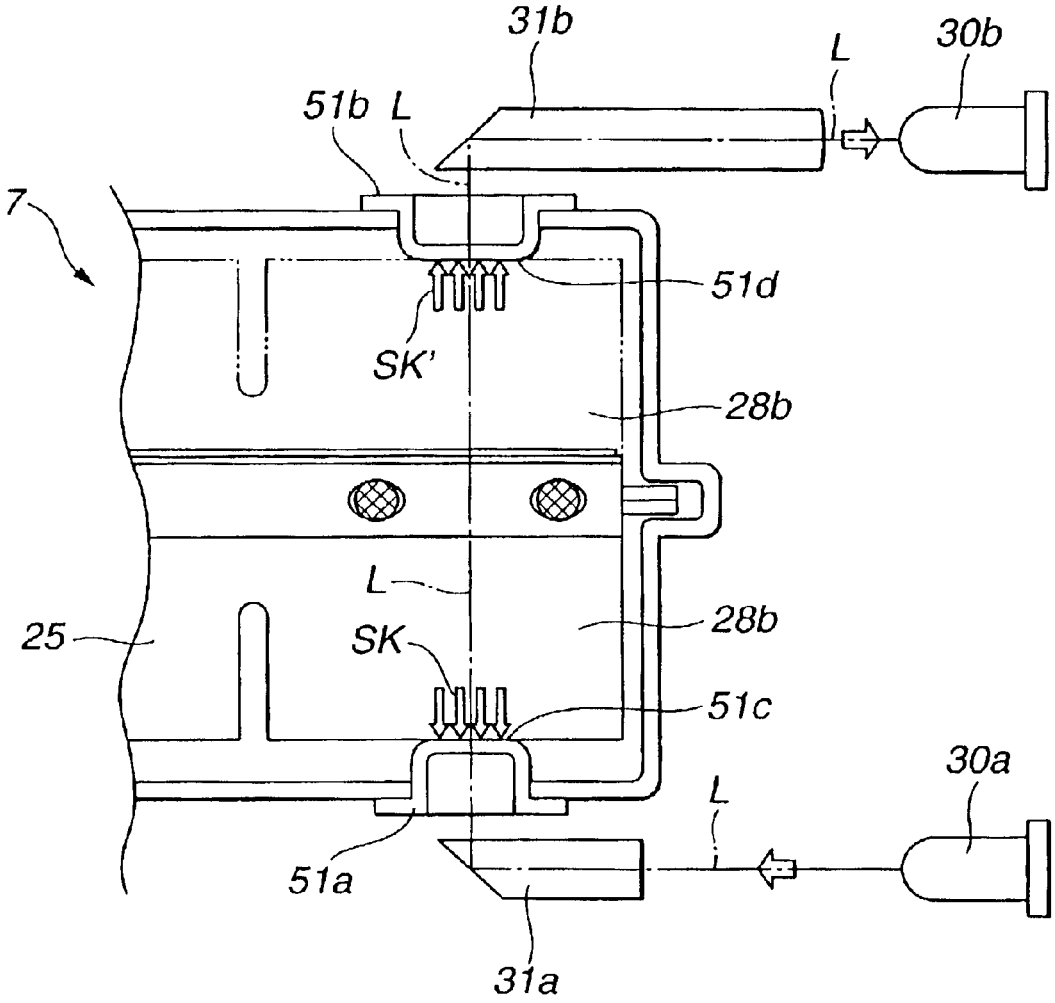

As shown in FIGS. 7 and 8, a light emitting device 30*a*, serving as a light emitting member, and a photosensing device 30*b*, serving as a photosensing member, that are provided at the main body of the image forming apparatus A are disposed at one side of the developer container 25.

Part of detection light L emitted from the light emitting device 30*a* passes through a light guide portion 45*a* of the light guide 45 disposed along the longitudinal direction of the developer container 25, at the outside of the developer container 25. The longitudinal axis of the light guide portion 45*a* is parallel to the longitudinal axis of the developer container 25. The detection light L, after leaving the light guide portion 45*a* enters the opening 25*b*, and after leaving the opening 25*b* enters the developer accommodating portion 25*a* of the developer container 25 by being refracted (or reflected) at the portion 46*c*.

The detection light L having entering and passed through the developer accommodating portion 25*a* is incident on and enters the light guide 46, which deflects the light L as it passes therethrough. Part of the detection light L reaches the photosensing device 30*b* via the light guide portion 46*a* disposed along the longitudinal direction of the developer container 25. The longitudinal axis of the light guide portion 46*a* is parallel to the longitudinal axis of the developer container 25. The remaining amount of the toner T accommodated within the developer container 25 is detected during the time period of detection of the detection light L by the photosensing device 30*b*. The light emitting device 30*a* is disposed near a lower portion of the process cartridge 7 and the photosensing device 30*b* is disposed near an upper portion of the process cartridge 7, in the main body of the image forming apparatus A.

The ratio of the time period of detection of the detection light L by the photosensing device 30*b* to the time period during which the photosensing device 30*b* does not detect the detection light L changes depending on the amount of the toner T within the developer container 25*a*. That is, when the toner T occupies the space in the developer accommodating portion 25*a* through which the detection light L travels between opening 25*b* and opening 25*c*, the light entering the developer accommodating portion 25*a* via the light guide portion 45*a* does not reach the light guide portion 46*a* because it is blocked by the toner T, and therefore, the photosensing device 30*b* cannot sense the light. This blocking of the detection light occurs constantly when the developer accommodation portion 25*a* is occupied by toner T to a certain degree or by a predetermined amount and occurs intermittently when the toner T begins to be used up and the rotating feeding member 28 rotates to change the portions of developer accommodation portion 25*a* occupied by the toner T.

As the toner T within the developer accommodating portion 25*a* decreases, the ratio of the time during which the light passes between the light guide portions 45*a* and 46*a* to the time during which the light does not pass between the light guide portions 45*a* and 46*b* gradually increases, due to the decrease in toner T and the stirring of the rotating feeding member 28. Thus, the remaining amount of the toner T can be detected.

According to this configuration, it is possible to successively detect the remaining amount of the toner T accommodated within the developer container 25 by changes in the period of time detection light L is detected by the photosensor 30*b*. The user is notified when the toner T tends to disappear in the developer container 25 by notifying means (not shown).

Next, the configurations of the light guides 45 and 46 will be described. As shown in FIGS. 9-12 in detail, the light guides 45 and 46 are used for detecting the remaining amount of the toner T accommodated in the developer accommodating portion 25*a*.

The light guides 45 and 46 include light-transmitting windows 45*b* and 46*b*, respectively, for abutting the openings 25*b* and 25*c* provided in the developer accommodating portion 25*a* when being mounted in the developer accommodating portion 25*a*. The light guides 45 and 46 also include, respectively, the light guide portions 45*a* and 46*a* for guiding light, provided at portions outside of the developer accommodating unit 25*a* with respect to the light-transmitting windows 45*b* and 46*b*, external inclined portions 45*c* and 46*c* inclined with respect to the light-transmitting windows 45*b* and 46*b*, respectively, at an angle of about 45 degrees, and provided at end portions of the light guide portions 45*a* and 46*a* in the longitudinal directions of the light guide portions 45*a* and 46*a*, and internal or inner inclined portions 45*d* and 46*d* inclined in directions crossing the longitudinal directions of the light guide portions 45*a* and 46*a*, provided at portions inside of the developer accommodating portion 25*a* with respect to blocking portions 45*h* and 46*h*, respectively. The inner inclined portions 45*d* and 46*d* are surfaces of the light transmitting windows 45*b* and 46*b*, respectively, that face the inside of the developer accommodating portion 25*a*. Each of the light guides 45 and 46 is integrally formed using a transparent material.

The detection light L emitted from the light emitting device 30*a* is guided into the developer accommodating portion 25*a* of the developer container 25 via the light-transmitting window 45*b*, serving as a first light-transmitting window. The detection light L passing through the developer accommodating portion 25*a* via the light-transmitting window 45*b* reaches the photosensor 30*b* via the light-transmitting window 46*b*, serving as a second light-transmitting window.

The light guides 45 and 46 are used for guiding light emitted from the light emitting device 30*a* into the developer accommodating portion 25*a*, and for guiding light passing through the developer accommodating portion 25*a* to the photosensor 30*b*. The light-transmitting window 45*b* includes a viewing portion 45*k* through which the color of the toner T accommodated within the developer accommodating portion 25*a* can be viewed.

An end portion 46*e* of the light guide portion 46*a* of the light guide 46 in the longitudinal direction is convex toward the photosensor 30*b*. It is thereby possible to focus light leaving the light guide portion 46*a* onto the photosensor 30*b*. In FIGS. 9A through 9D, an end portion 45*e* is opposite to the end portion of the light guide portion 45*a* of the light guide 45 facing the light-transmitting window 45*b* in the longitudinal direction of the light guide portion 45*a*.

The light guides 45 and 46 are obtained by integrally forming the light guide portions 45*a* and 46*a* and the blocking portions 45*h* and 46*h*, respectively, that are made of a transparent material, such as polystyrene or the like.

The light guides 45 and 46 also include ultrasonically welded ribs 45*g* and 46*g*, that are welded at portions near the openings 25*b* and 25*c* of the developing container 25, respectively. The light guides 45 and 46 also include flanges 45*f* and 46*f*, respectively. Each of the flanges 45*f* and 46*f* receives an ultrasonic horn during ultrasonic welding. The flanges 45*f* and 46*f* are fixed on outer edges of the openings 25*b* and 25*c* according to ultrasonic welding.

The developer accommodating portion 25*a* includes the rotating feeding member 28 for feeding the toner T accommodated within the developer accommodating portion 25*a* toward a portion where developing members, such as the developing roller 27 and the like, are provided. The stirring blade 28*b*, made of a flexible plastic sheet, provided on the rotating feeding member 28 contacts the inner inclined portions 45*d* and 46*d* of the light-transmitting windows 45*b* and 46*b* provided at the light guides 45 and 46, respectively, at every rotation of the rotating feeding member 28.

By sliding contact of the stirring blade 28*b* of the rotating feeding member 28 with the inner inclined portions 45*d* and 46*d* of the light-transmitting windows 45*b* and 46*b*, respectively, the inner inclined portions 45*d* and 46*d* that tend to be stained by the toner T are always cleaned.

Improvement in light transmittance according to the embodiment will now be described. As shown in FIGS. 8, 9A-9D, and 10A-10D, the inner inclined portions 45*d* and 46*d* of the light-transmitting windows 45*b* and 46*b*, respectively, have a circular convex shape, convex in or along the longitudinal direction of the rotating feeding member 28.

The convex shape will now be described in detail. The convex shape is formed so that the detection light L passes through a substantially central portion of each of the inner inclined portions 45*d* and 46*d*. As shown in FIG. 8, the inner inclined portions 45*d* and 46*d* have a circular convex shape so that the height gradually increases from edge portions toward apex portions 45*d*1 and 46*d*1 in the longitudinal direction of the rotating feeding member 28.

The stirring blade 28*b* contacts convex portions of the inner inclined portions 45*d* and 46*d* at every rotation, and wipes the circular convex apex portions 45*d*1 and 46*d*1 of the inner inclined portions 45*d* and 46*d* with concentrated wiping forces TK and TK7, respectively. As a result, the toner T adhering to the circular convex apex portions 45*d*1 and 46*d*1 near the center of the optical axes of the inner inclined portions 45*d* and 46*d*, respectively, can be very well wiped.

In the above-described embodiment, by using the optical guides 45 and 46 integrated with the light-transmitting windows 45*b* and 46*b*, respectively, a larger percentage of light can arrive from the light emitting device 30*a* to the photosensor 30*b* by minimizing passage of light through a different medium (i.e., toner). Since the inner inclined portions 45*d* and 46*d* have a circular convex shape in the longitudinal direction of the rotating feeding member 28, convex portions of the inner inclined portions 45*d* and 46*d* are wiped with a concentrated force. As a result, a larger percentage of light can reach the photosensor 30*b*, and light transmission with high reliability can be realized. Since the reliability of light transmission is high, it is possible to reduce power consumption by reducing the output capacity of the light emitting device 30*a*, and reduce the cost of the light emitting device 30*a* by avoiding redundant design.

In the present invention having the above-described configuration and operations, the inner inclined portions of the light-transmitting windows have a circular convex shape in the longitudinal direction of the rotating feeding member. As a result, the convex portions can be wiped with a concentrated force, so that a larger percentage of light can reach the photosensor, and very reliable light transmission can be realized. Since the reliability of light transmission is high, it is possible to reduce power consumption by reducing the output capacity of the light emitting device.

As described above, according to the present invention, it is possible to exactly detect the remaining amount of a developer accommodated within a developer container.

According to the present invention, it is possible to reduce loss in detection light for detecting the remaining amount of a developer accommodated within a developer container.

According to the present invention, it is also possible to easily remove developer adhering to light-transmitting windows for detecting the remaining amount of a developer accommodated within a developer container.

According to the present invention, it is further possible to reduce power consumption of a light emitting member for detecting the remaining amount of a developer accommodated within a developer container.

The individual components shown in outline in the drawings are all well known in the image forming apparatus, process cartridge, developing device and developer container arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developer container for accommodating a developer used for developing an electrostatic latent image formed on an electrophotographic photosensitive member by means of a developing member for developing the electrostatic latent image, said developer container comprising:

a first light-transmitting window configured and positioned to guide detection light emitted from a light emitting member provided in a main body of an image forming apparatus into said developer container, in order to detect a remaining amount of the developer accommodated within said developer container when said developer container is mounted in the main body of the image forming apparatus;

a second light-transmitting window configured and positioned to guide the detection light, entering from said first light-transmitting window and passing through said developer container, to a photosensing member provided in the main body of the image forming apparatus, in order to detect the remaining amount of the developer accommodated within said developer container when said developer container is mounted in the main body of the image forming apparatus; and a rotatable feeding member comprising a stirring blade configured and positioned to feed the developer within said developer container toward the developing member when rotating, and to remove particles of the developer adhering to said first light-transmitting window and said second light-transmitting window by contacting said first light-transmitting window and said second light-transmitting window, wherein at least one of the respective inner surfaces of said first light-transmitting window and said second light-transmitting window facing the inside of said developer container has an inner inclined portion having a circular convex portion whose central portion is raised from both end sides in the longitudinal direction of said rotatable feeding member, wherein said inner inclined portion is inclined in a direction crossing the longitudinal direction of said rotatable feeding member, and wherein when said rotatable feeding member rotates, said stirring blade slidingly contacts said circular convex portion along said inner inclined portion to remove developer from said inner inclined portion.

2. A developer container according to claim 1, wherein the detection light passes through a substantially central portion of said circular convex portion.

3. A developer container according to claim 1, further comprising a light guide unit positioned and configured to guide the detection light emitted from the light emitting member to said first light-transmitting window.

4. A developer container according to claim 3, wherein said first light-transmitting window and said light guide unit are integrally formed.

5. A developer container according to claim 1, further comprising a light guide unit positioned and configured to guide the detection light entering said second light-transmitting window to the photosensing member.

6. A developer container according to claim 5, wherein said second light-transmitting window and said light guide unit are integrally formed.

7. A developing device for developing an electrostatic latent image formed on an electrophotographic photosensitive member, said developing device comprising:

a developing member configured and positioned to develop the electrostatic latent image; and a developer container configured and positioned to accommodate a developer used by said developing member, said developer container comprising:

a first light-transmitting window configured and positioned to guide detection light emitted from a light emitting member provided in a main body of an image forming apparatus into said developer container, in order to detect a remaining amount of the developer accommodated within said developer container when said developer container is mounted in the main body of the image forming apparatus;

a second light-transmitting window configured and positioned to guide the detection light, entering from said first light-transmitting window and passing through said developer container, to a photosensing member provided in the main body of the image forming apparatus, in order to detect the remaining amount of the developer accommodated within said developer container when said developer container is mounted in the main body of the image forming apparatus; and a rotatable feeding member comprising a stirring blade configured and positioned to feed the developer within said developer container toward said developing member when rotating, and to remove particles of the developer adhering to said first light-transmitting window and said second light-transmitting window by contacting said first light-transmitting window and said second light-transmitting window, wherein at least one of the respective inner surfaces of said first light-transmitting window and said second light-transmitting window facing the inside of said developer container has an inner inclined portion having a circular convex portion whose central portion is raised from both end sides in the longitudinal direction of said rotatable feeding member, wherein said inner inclined portion is inclined in a direction crossing the longitudinal direction of said rotatable feeding member, and wherein when said rotatable feeding member rotates, said stirring blade slidingly contacts said circular convex portion along said inner inclined portion to remove developer from said inner inclined portion.

8. A developing device according to claim 7, wherein the detection light passes through a substantially central portion of said circular convex portion.

9. A developing device according to claim 7, further comprising a light guide unit positioned and configured to guide the detection light emitted from the light emitting member to said first light-transmitting window.

10. A developing device according to claim 9, wherein said first light-transmitting window and said light guide unit are integrally formed.

11. A developing device according to claim 7, further comprising a light guide unit positioned and configured to guide the detection light entering said second light-transmitting window to the photosensing member.

12. A developing device according to claim 11, wherein said second light-transmitting window and said light guide unit are integrally formed.

13. A process cartridge capable of being detachably mounted in an image forming apparatus, comprising:

an electrophotographic photosensitive member;

process means for operating on said electrophotographic photosensitive member;

a developing member configured and positioned to develop an electrostatic latent image formed on said electrophotographic photosensitive member; and a developer container configured and positioned to accommodate a developer used by said developing member, said developer container comprising:

a first light-transmitting window configured and positioned to guide detection light emitted from a light emitting member provided in a main body of the image forming apparatus into said developer container, in order to detect a remaining amount of the developer accommodated within said developer container when said process cartridge is mounted in the main body of the image forming apparatus;

a second light-transmitting window configured and positioned to guide the detection light, entering from said first light-transmitting window and passing through said developer container, to a photosensing member provided in the main body of the image forming apparatus, in order to detect the remaining amount of the developer accommodated within said developer container when said process cartridge is mounted in the main body of the image forming apparatus; and a rotatable feeding member comprising a stirring blade configured and positioned to feed the developer within said developer container toward said developing member when rotating, and to remove particles of the developer adhering to said first light-transmitting window and said second light-transmitting window by contacting said first light-transmitting window and said second light-transmitting window, wherein at least one of the respective inner surfaces of said first light-transmitting window and said second light-transmitting window facing the inside of said developer container has an inner inclined portion having a circular convex portion whose central portion is raised from both end sides in the longitudinal direction of said rotatable feeding member, wherein said inner inclined portion is inclined in a direction crossing the longitudinal direction of said rotatable feeding member, and wherein when said rotatable feeding member rotates, said stirring blade slidingly contacts said circular convex portion along said inner inclined portion to remove developer from said inner inclined portion.

14. A process cartridge according to claim 13, wherein the detection light passes through a substantially central portion of said circular convex portion.

15. A process cartridge according to claim 13, comprising a light guide unit positioned and configured to guide the detection light emitted from the light emitting member to said first light-transmitting window.

16. A process cartridge according to claim 13, further comprising a light guide unit positioned and configured to guide the detection light entering said second light-transmitting window to the photosensing member.

17. An image forming apparatus, capable of detachably mounting a process cartridge, for forming an image on a recording medium, said image forming apparatus comprising:

(i) a main body, (ii) a light emitting member in said main body and configured to emit detection light;

(iii) a photosensing member in said main body and configured and positioned to receive the detection light emitted by said light emitting member;

(iv) mounting means for detachably mounting the process cartridge comprising an electrostatic photosensitive member, process means for operating on the electrophotographic photosensitive member, a developing member configured and positioned to develop an electrostatic latent image formed on the electrostatic photosensitive member, and a developer container configured and positioned to accommodate a developer used by the developing member, the developer container comprising a first light-transmitting window configured and positioned to guide the detection light emitted from said light emitting member provided in said main body of said image forming apparatus into the developer container, in order to detect a remaining amount of the developer accommodated within the developer container when the process cartridge is mounted in said main body of said image forming apparatus, a second light-transmitting window configured and positioned to guide the detection light, entering from the first light-transmitting window and passing through the developer container, to said photosensing member provided in said main body of said image forming apparatus, in order to detect the remaining amount of the developer accommodated within the developer container when the process cartridge is mounted in said main body of said image forming apparatus, and a rotatable feeding member comprising a stirring blade configured and positioned to feed the developer within the developer container toward the developing member when rotating, and to remove particles of the developer adhering to the first light-transmitting window and the second light-transmitting window by contacting the first light-transmitting window and the second light-transmitting window, wherein at least one of the respective inner surfaces of the first light-transmitting window and the second light-transmitting window facing the inside of the developer container has an inner inclined portion having a circular convex portion whose central portion is raised from both end sides in the longitudinal direction of the rotatable feeding member, the inner inclined portion being inclined in a direction crossing the longitudinal direction of the rotatable feeding member, and wherein when the rotatable feeding member rotates, the stirring blade slidingly contacts the circular convex portion along the inner inclined portion to remove developer from the inner inclined portion; and (v) conveyance means for conveying the recording medium.

* * * * *

UNITED STATES PATENT AND TRADEMARK OFFICE

CERTIFICATE OF CORRECTION

PATENT NO. : 6,859,629 B2
DATED : February 22, 2005
INVENTOR(S) : Koji Miura et al.

It is certified that error appears in the above-identified patent and that said Letters Patent is hereby corrected as shown below:

Title page,
Item [56], References Cited, FOREIGN PATENT DOCUMENTS, "08123187 A" should read -- 08-123187 A --.

Column 1,
Lines 42 and 48, "light-transmitting" should read -- light-transmitting, --.

Column 2,
Line 24, "sheet" should read -- sheet, --.
Lines 44 and 66, "and an" should read -- an --.

Column 3,
Lines 18 and 53, "light" should read -- light, --.
Lines 19 and 54, "container" should read -- container, --.

Column 4,
Line 23, "light" should read -- light, --.
Line 24, "container" should read -- container, --.

Column 5,
Line 32, "guide" should read -- guiding --.
Line 33, "said" (both occurrences) should read -- the --.
Line 42, "guiding" should read -- first guiding --.
Line 52, "second light-" should read -- second guiding means --.
Line 53, "transmitting window" should be deleted.

Column 7,
Line 13, "light," should read -- light and --.
Line 35, "feed" should read -- feeding --.

Column 8,
Line 19, "wherein" should read -- and --.

Column 9,
Line 40, "the the at" should read -- the at --.
Line 44, "mean," should read -- means, --.
Line 61, "developer amount" should read -- developer-amount --.

Column 12,
Line 56, "of developer accommodating" should be deleted.
Line 57, "portion 25a" should be deleted.

UNITED STATES PATENT AND TRADEMARK OFFICE

CERTIFICATE OF CORRECTION

PATENT NO. : 6,859,629 B2
DATED : February 22, 2005
INVENTOR(S) : Koji Miura et al.

It is certified that error appears in the above-identified patent and that said Letters Patent is hereby corrected as shown below:

Column 13,
Line 48, “and a” should read -- and to a --.

Column 14,
Line 56, “downward. (Configuration of mounting/detaching of” should read -- downward. --.
Line 57, “the process cartridge)” should read -- CONFIGURATION OF MOUNTING/ DETACHING OF THE PROCESS CARTRIDGE --.

Column 15,
Line 40, “thereon” should read -- thereon, --.

Column 16,
Line 24, “37” should read -- 37, --.
Line 38, “transmitting” should read -- transmitting, --.
Line 58, “A” should read -- A, --.

Column 18,
Line 58, “28” should read -- 28, --.

Column 19,
Line 13, “height” should read -- height thereof --.
Line 20, “TK7,” should read -- $TK^1$, --.

Column 23,
Line 7, “body,” should read -- body; --.

Signed and Sealed this

Sixth Day of December, 2005

JON W. DUDAS
*Director of the United States Patent and Trademark Office*